US006648840B2

(12) United States Patent
Cutler et al.

(10) Patent No.: US 6,648,840 B2
(45) **Date of Patent: *Nov. 18, 2003**

(54) MICROCONTROLLER BASED MASSAGE SYSTEM

(75) Inventors: Stanley Cutler, Van Nuys, CA (US); Gayle B. Gerth, Dana Point, CA (US); Alton B. Otis, Jr., Port Townsend, WA (US); Taylor Chau, Cerritos, CA (US)

(73) Assignee: Salton, Inc., Mount Prospect, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/242,007

(22) PCT Filed: Jul. 28, 1997

(86) PCT No.: PCT/US97/13179

§ 371 (c)(1),
(2), (4) Date: May 28, 1999

(87) PCT Pub. No.: WO98/05288

PCT Pub. Date: Feb. 12, 1998

(65) Prior Publication Data

US 2002/0111570 A1 Aug. 15, 2002

Related U.S. Application Data

(63) Continuation of application No. 08/901,374, filed on Jul. 28, 1997, now Pat. No. 6,039,702.
(60) Provisional application No. 60/022,977, filed on Aug. 2, 1996.

(51) Int. Cl.[7] ..... A61H 23/02

(52) U.S. Cl. ..... 601/15; 601/57

(58) Field of Search ..... 601/46, 47, 48, 601/49, 56, 57, 58, 59, 60, 70

(56) References Cited

U.S. PATENT DOCUMENTS

| | | | | |
|---|---|---|---|---|
| 1,608,239 A | | 11/1926 | Rosett | |
| 2,361,242 A | | 10/1944 | Rosett | 128/299 |
| 2,528,843 A | | 11/1950 | Poor et al. | 128/24 |
| 2,533,504 A | | 12/1950 | Poor et al. | 128/24 |
| 2,781,041 A | | 2/1957 | Weinberg | 128/60 |
| 2,893,382 A | | 7/1959 | Demeny | 128/38 |
| 2,924,216 A | * | 2/1960 | Stewart | |
| 3,177,866 A | | 4/1965 | Wesslund | 128/24 |
| 3,297,023 A | | 1/1967 | Foley | 128/33 |

(List continued on next page.)

FOREIGN PATENT DOCUMENTS

| | | | |
|---|---|---|---|
| CA | 1133347 | 10/1982 | 128/17 |
| CA | 2070031 | 12/1992 | A61H/9/00 |
| DE | 1903217 | 1/1969 | |

(List continued on next page.)

*Primary Examiner*—Danton D. DeMille
(74) *Attorney, Agent, or Firm*—Sonnenschein, Nath & Rosenthal

(57) ABSTRACT

A massaging system includes a pad comprising with multiple zones sand vibratory transducers in the pad for vibrating the zones. Each transducer includes a motor and a mass element eccentrically coupled to the motor. The massaging system also includes a microcontroller having an input interface and an output interface, a program memory coupled to the microcontroller, and input elements coupled to the input interface for signaling the microcontroller in response to operator input. A motor driver coupled to the output interface and the vibratory transducers drives the vibratory transducers in response to the operator input, while firmware stored in the memory and executed by the microcontroller selectively operates the vibratory transducers in a tapping mode and a wave mode in response to the operator input.

27 Claims, 9 Drawing Sheets

Microfiche Appendix Included
(1 Microfiche, 45 Pages)

U.S. PATENT DOCUMENTS

| | | | | | |
|---|---|---|---|---|---|
| 3,411,496 | A | | 11/1968 | Strehler | 128/24 |
| 3,659,593 | A | | 5/1972 | Vail | 128/64 |
| 3,701,173 | A | | 10/1972 | Whitney | 128/33 |
| 3,826,249 | A | | 7/1974 | Lee et al. | 128/24 |
| 3,867,732 | A | | 2/1975 | Morrell | 5/349 |
| 3,885,554 | A | | 5/1975 | Rockwell, Jr. | 128/24 |
| 3,920,006 | A | | 11/1975 | Lapidus | 128/24 |
| 4,013,069 | A | | 3/1977 | Hasty | 128/24 |
| 4,030,488 | A | | 6/1977 | Hasty | 128/24 |
| 4,064,376 | A | * | 12/1977 | Yamada | 381/152 |
| 4,156,425 | A | | 5/1979 | Arkans | 128/24 |
| 4,157,088 | A | * | 6/1979 | Gracey | |
| 4,198,961 | A | | 4/1980 | Arkans | 128/24 |
| 4,202,325 | A | | 5/1980 | Villari et al. | 128/24 |
| 4,207,875 | A | | 6/1980 | Arkans | 128/24 |
| 4,207,876 | A | | 6/1980 | Annis | 128/24 |
| 4,225,989 | A | | 10/1980 | Corbett et al. | 5/469 |
| 4,253,449 | A | | 3/1981 | Arkans et al. | 128/24 |
| 4,311,135 | A | | 1/1982 | Brueckner et al. | 128/24 |
| 4,374,518 | A | | 2/1983 | Villanueva | 128/24 |
| 4,453,538 | A | | 6/1984 | Whitney | 128/24 |
| 4,577,626 | A | | 3/1986 | Marukawa et al. | 128/64 |
| 4,590,925 | A | | 5/1986 | Dillon | 128/24 |
| 4,624,244 | A | | 11/1986 | Taheri | 128/24 |
| 4,762,121 | A | | 8/1988 | Shienfeld | 128/64 |
| 4,779,615 | A | * | 10/1988 | Frazier | |
| 4,938,208 | A | | 7/1990 | Dye | 128/87 |
| 4,989,589 | A | | 2/1991 | Pekanmaki et al. | 128/64 |
| 5,007,411 | A | | 4/1991 | Dye | 128/64 |
| 5,022,387 | A | | 6/1991 | Hasty | 128/64 |
| 5,031,604 | A | | 7/1991 | Dye | 128/64 |
| 5,109,832 | A | | 5/1992 | Proctor et al. | 128/24 |
| 5,179,941 | A | | 1/1993 | Siemssen et al. | 128/40 |
| 5,188,096 | A | * | 2/1993 | Yoo | |
| 5,245,990 | A | | 9/1993 | Bertinin | 128/64 |
| 5,342,285 | A | | 8/1994 | Dye | 601/151 |
| 5,383,842 | A | | 1/1995 | Bertini | 601/151 |
| 5,437,608 | A | * | 8/1995 | Cutler | |
| 5,584,798 | A | | 12/1996 | Fox | 601/152 |
| 5,588,954 | A | | 12/1996 | Ribando et al. | 601/149 |
| 5,626,556 | A | | 5/1997 | Tobler et al. | 601/151 |
| 5,713,832 | A | * | 2/1998 | Jain | 601/49 |
| 5,725,485 | A | | 3/1998 | Ribando et al. | 601/152 |
| 5,795,312 | A | | 8/1998 | Dye | 601/151 |
| 5,843,007 | A | | 12/1998 | McEwen et al. | 601/152 |
| 5,876,359 | A | * | 3/1999 | Bock et al. | 601/150 |
| 5,938,627 | A | | 8/1999 | Hickman | 601/149 |
| 5,938,628 | A | | 8/1999 | Oguri et al. | 601/150 |
| 6,123,681 | A | | 9/2000 | Brown, III | 602/75 |

FOREIGN PATENT DOCUMENTS

| | | | | |
|---|---|---|---|---|
| DE | 2239331 | | 8/1972 | |
| DE | 3537210 | * | 4/1986 | |
| EP | 0026799 | | 2/1985 | A61H/23/04 |
| EP | 0038820 | | 11/1986 | B23K/35/22 |
| EP | 0129481 | | 8/1990 | A61H/23/04 |
| EP | 0392669 | | 10/1990 | A61H/23/04 |
| EP | 0392670 | | 10/1990 | A61H/23/04 |
| EP | 0542383 | | 5/1993 | A61H/9/00 |
| FR | 2267751 | | 4/1974 | A61H/9/00 |
| FR | 2371914 | | 11/1976 | |
| FR | 2511241 | | 2/1983 | |
| FR | 2583978 | | 6/1985 | A61H/9/00 |
| GB | 483111 | | 4/1938 | |
| GB | 483132 | | 4/1938 | |
| GB | 1234238 | | 6/1971 | A61H/5/04 |
| GB | 1531268 | | 11/1978 | A61F/5/01 |
| GB | 2068737 | | 8/1981 | A61H/9/00 |
| JP | 549661 | | 3/1993 | |
| JP | 406269484 A | * | 9/1994 | |
| RU | 839534 | | 6/1981 | A61H/9/00 |
| RU | 1412784 | | 7/1988 | A61H/9/00 |
| WO | 9715264 | * | 5/1997 | |

* cited by examiner

MICROCONTROLLER BASED MASSAGE SYSTEM

This application is a 35 U.S.C. 371 national stage application of PCT/US97/1317 and a continuation of Ser. No. 08/901,374 filed Jul. 28, 1997 U.S. Pat. No. 6,039,702 which is a continuation of provisional No. 60/022,977 filed Aug. 2, 1996 now abandoned.

REFERENCE TO APPENDIX

Attached hereto and incorporated herein is Appendix A, which is the hard copy print out of the assembly listing of the source code for the "Samsung Assembly Language" computer programs, which program (configure) the processors and computers disclosed herein to implement the methods and procedures described herein. Appendix A consists of 45 pg. Also attached hereto and incorporated herein is a Microfiche Appendix, which is a microfiche copy of the assembly listing of the source code for the "Samsung Assembly Language" computer programs as listed in Appendix A, which program (configure) the processors and computers disclosed herein to implement the methods and procedures described herein. The microfiche Appendix consists of a single original microfiche copy. This assembly listing is subject to copyright protection. The copyright owner has no objection to the facsimile reproduction of the patent disclosure, as it appears in the Patent and Trademark Office patent files or records, but otherwise reserves all copyright rights whatsoever.

BACKGROUND

The present invention relates to a massaging apparatus, and more particularly to an improved microcontroller based controller for such apparatus. Conventional massaging apparatus is essentially manually operated. Although electronic sources produce varying types of vibrations variously applied to the user's body, these are limited, essentially because they are, at least, modestly integrated. For example, a source of audio from a tape may form the programming source. In general, more sophistication in the massaging and heating of the body is desired, not only as a sales tactic but also and, perhaps more importantly, as an adjunct to medical treatment.

SUMMARY

The present invention provides a microcontroller based massage system utilizing small DC motors with eccentric mass elements as the vibratory source. The motors are embedded in a pad upon which the user lies or reclines. The pad may also contain embedded heaters to enhance the massage. The system is activated via a remote control device containing key switches or push buttons and visual status indicators. The wand connects to the massage pad via a cable. The wand and massage pad are powered from either a wall transformer or a battery, the latter affording portable operation. In its fullest implementation, the massage pad is body length and contains a plurality of motors and heaters. Typically, the heaters are located in the center of the shoulder and lower back areas and the motors are located in 5 zones distributed over the body length. Several advantages are derived from this arrangement. Computerizing the various modes and operations facilitates the use of the massaging and heating apparatus. Thus, the user can experience a wider variety of massage. A larger variety of options of vibrating sources and how they inter-operate is made available. Total operational variety is simpler to obtain through computer programming than manually.

In one aspect of the invention, the system can be powered from a first source having a voltage drop as loads are applied, wherein each motor power signal has a maximum duty cycle being a base duty cycle plus a load increment duty cycle for each of the motors being simultaneously activated, the microprocessor controller periodically activating the drivers for producing, in response to the intensity control value, respective operating duty cycles for the activated motors being limited to the maximum duty cycle. The system can further include a heater element in the pad, a heater driver responsive to the microprocessor controller for activating the heater element, wherein the signaling further includes a heat control input, and wherein the maximum duty cycle of each motor power signal is preferably augmented by a heater increment duty cycle when the heater element is activated for compensating voltage drops. Preferably the system has a duty cycle upper limit that is a base limit less a portion of the load increment for each of the motors being simultaneously activated and, if the heater element is activated, the upper limit being further reduced by a heater reduction duty cycle, the maximum duty cycle of each motor power signal being limited to not more than the duty cycle upper limit for limiting a maximum power from the first source. Each motor power signal can have a minimum duty cycle, the operational duty cycle being scaled from the product of the intensity control value and the maximum duty cycle less the minimum duty cycle, the minimum duty cycle being added to the product.

The heat control input can have off, high, and low states for selectively powering the heater at high power, low power, and no power, the microprocessor controller being operative for activating the heater driver to power the heater element at high power when the heat control input is high, at no power when the heat control input is off, and at low power when the heat control input is low, except preferably that when the heat control input is changed from off to low, the microprocessor controller is operative for powering the heater at high power for a warm up interval of time prior to the low power, the warm up interval being dependent on a time interval of the off state of the control input.

The system can be used additionally with a second power source not having a voltage drop as great as the voltage drop of the first source as loads are added, the system preferably including a power detector for sensing whether the second power source is being used, the microprocessor being programmed for increasing the base duty cycle and reducing the load increment duty cycle during operation from the second power source.

Preferably the system further includes a configuration selector for determining and signaling to the microprocessor controller particular components being electrically connected in the system for utilizing a single set of programmed instructions in the program memory in variously configured examples of the massaging system.

In another aspect of the invention, the system includes the pad, the plurality of vibratory transducers, the microprocessor controller, the array of input elements, the plurality of motor drivers, and the configuration selector. The input elements can be connected in a matrix for scanning by the microprocessor controller, the configuration selector including a plurality of diodes connected between respective portions of the matrix and the microprocessor controller.

In another aspect of the invention, the system includes the pad, at least one vibratory transducer, the heater element in the pad, the motor driver, the heater driver, the array of input elements, with the heat control input having off, high, and low states corresponding to high power, low power, and no power of the heater element, and the microprocessor controller being operative for activating the heater driver to power the heater at high power when the heat control input is high, at no power when the heat control input is off, and at low power when the heat control input is low, except that when the heat control input is changed from off to low, the microprocessor controller is operative for powering the heater at high power for a warm up interval of time prior to the low power, the period of time being dependent on a time interval of the off state of the control input.

In a further aspect of the invention, the massaging system includes the pad, the plurality of transducers, the heater element, the microprocessor controller, the array of input elements, with the signaling including at least one mode signal and the heat control input, the plurality of motor drivers, and the heater driver, the microprocessor controller being operative in response to the input elements for activating the motors and the heater element for operation thereof in correspondence with the input elements, and in a test mode wherein each of the motors and the heater is activated sequentially in accordance with substantially every state of the region signal, mode signal, and the heat control input, the motors being activated at power levels responsive to intensity control value. The signaling can further include a speed input for determining a rate of sequencing mode component intervals, and wherein, during the test mode, the sequential activation is at a rate proportional to the speed input.

In yet another aspect of the invention, the massaging system includes the pad and vibratory transducer, the array of input elements with the signaling including an audio mode signal, and an audio detector for detecting an audio envelope, the microprocessor controller being operative for generating the motor power signal in response to the audio envelope.

The invention also provides a method for massaging a user contacting a pad, using electrical power from a source having a voltage drop as loads are added, includes the steps of:

(a) providing a plurality of eccentric motor vibrators in respective regions of the pad;

(b) providing a microprocessor controller, an array of input elements for interrogation by the controller, and a plurality of drivers for powering the vibrators from the power source in response to the controller;

(c) interrogating the input elements by the controller to determine an intensity control value and vibrators to be activated;

(d) determining a maximum duty cycle being a base duty cycle plus a load increment duty cycle for each of the vibrators to be activated; and (e) periodically activating the drivers for producing respective operating duty cycles of activated motors being responsive to the intensity control value and limited to the maximum duty cycle.

The method can include the further steps of:

(a) providing a heater element in the pad;

(b) providing a heater driver for powering the heater element in response to the controller;

(c) the interrogating step includes determining a heat control input; and (d) the step of determining the maximum duty cycle comprising adding a heater increment duty cycle when the heater element is activated; determining a duty cycle upper limit being a base limit less a portion of the load increment for each of the motors being simultaneously activated and, if the heater element is activated, the upper limit being further reduced by a heater reduction duty cycle; and limiting the maximum duty cycle of each motor power signal to not more than the duty cycle upper limit.

DRAWINGS

These and other features, aspects, and advantages of the present invention will become better understood with reference to the following description, appended claims, and accompanying drawings, where:

Figure 1:
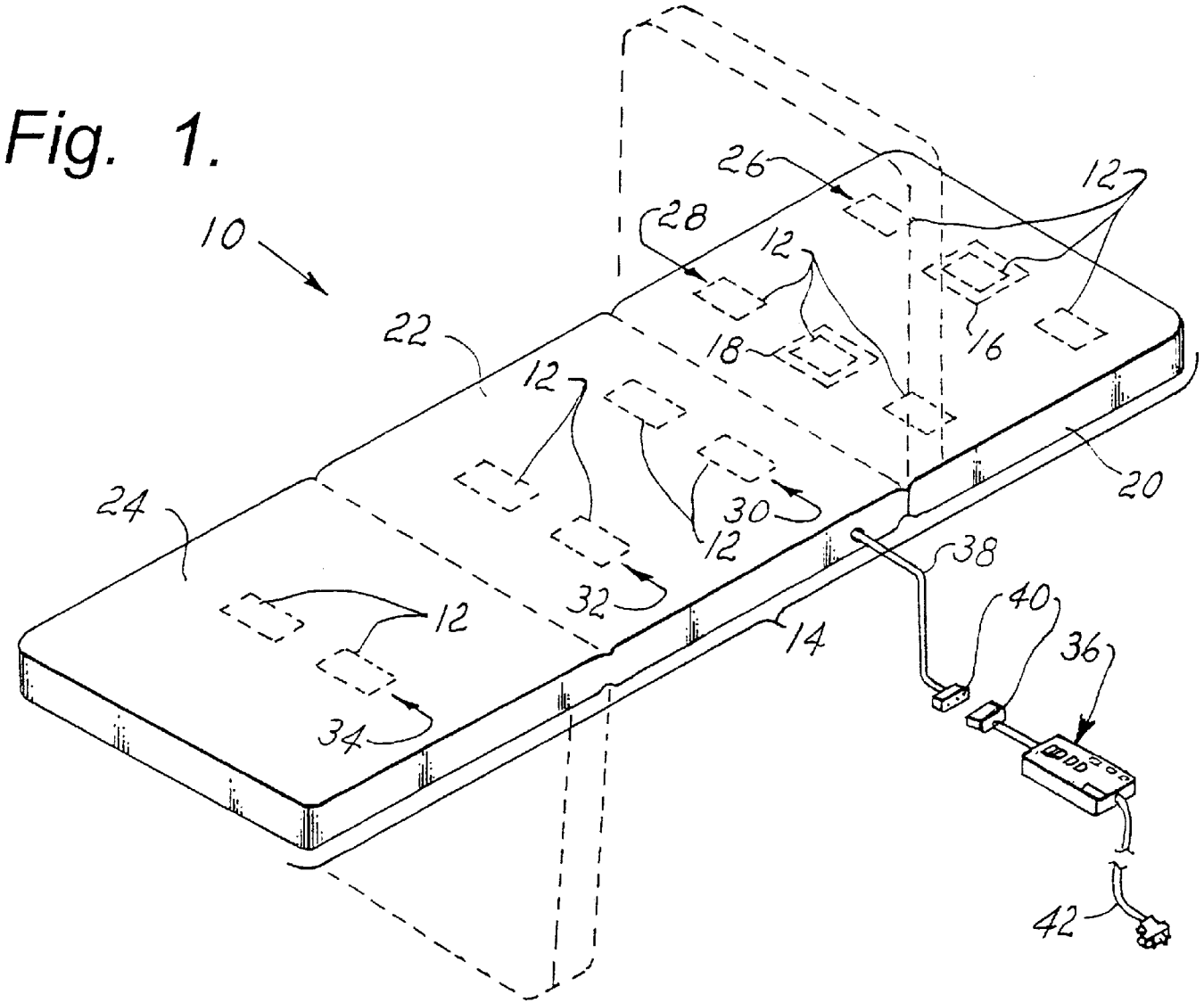
FIG. 1 is a perspective view of a massaging system according to the present invention.
Figure 2:
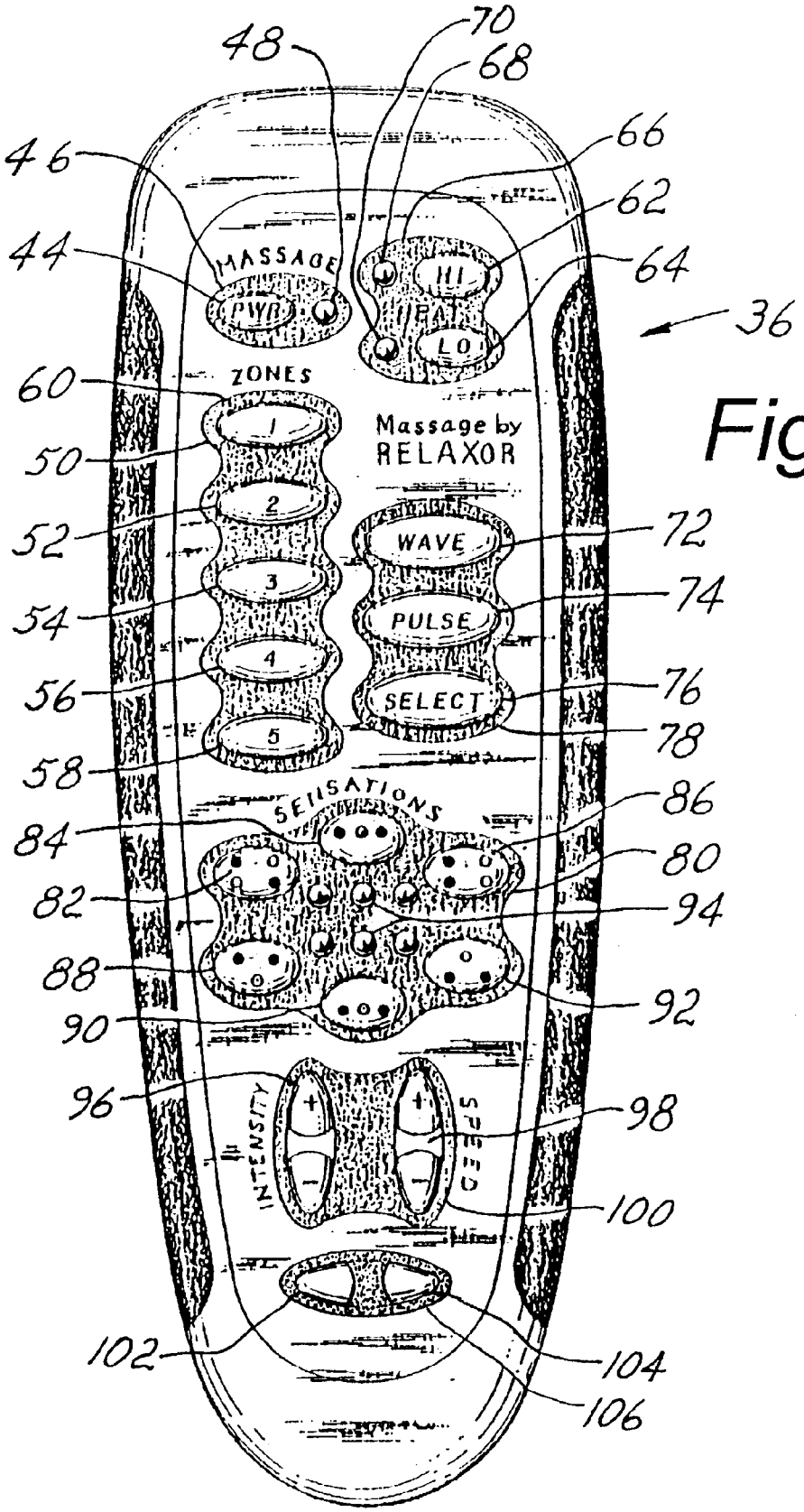
FIG. 2 is an enlarged view of a controller portion of the system of FIG. 1.
Figure 4A:
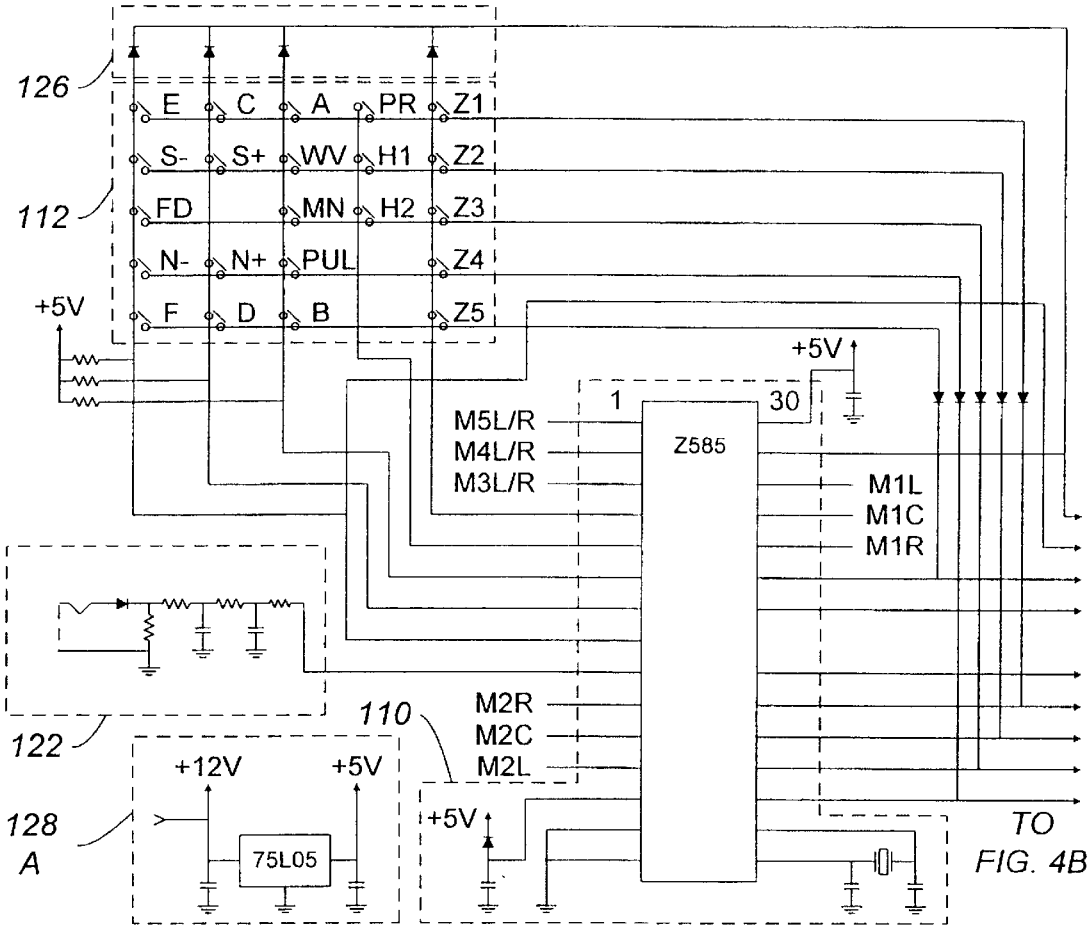
Figure 4A:
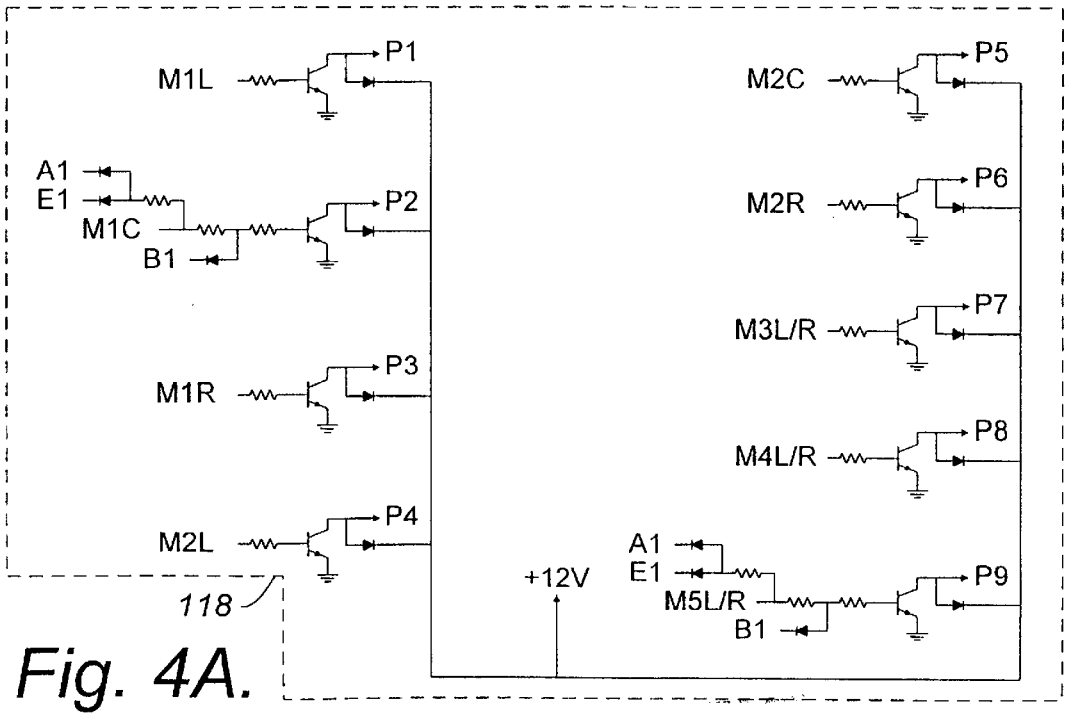
Figure 4B:
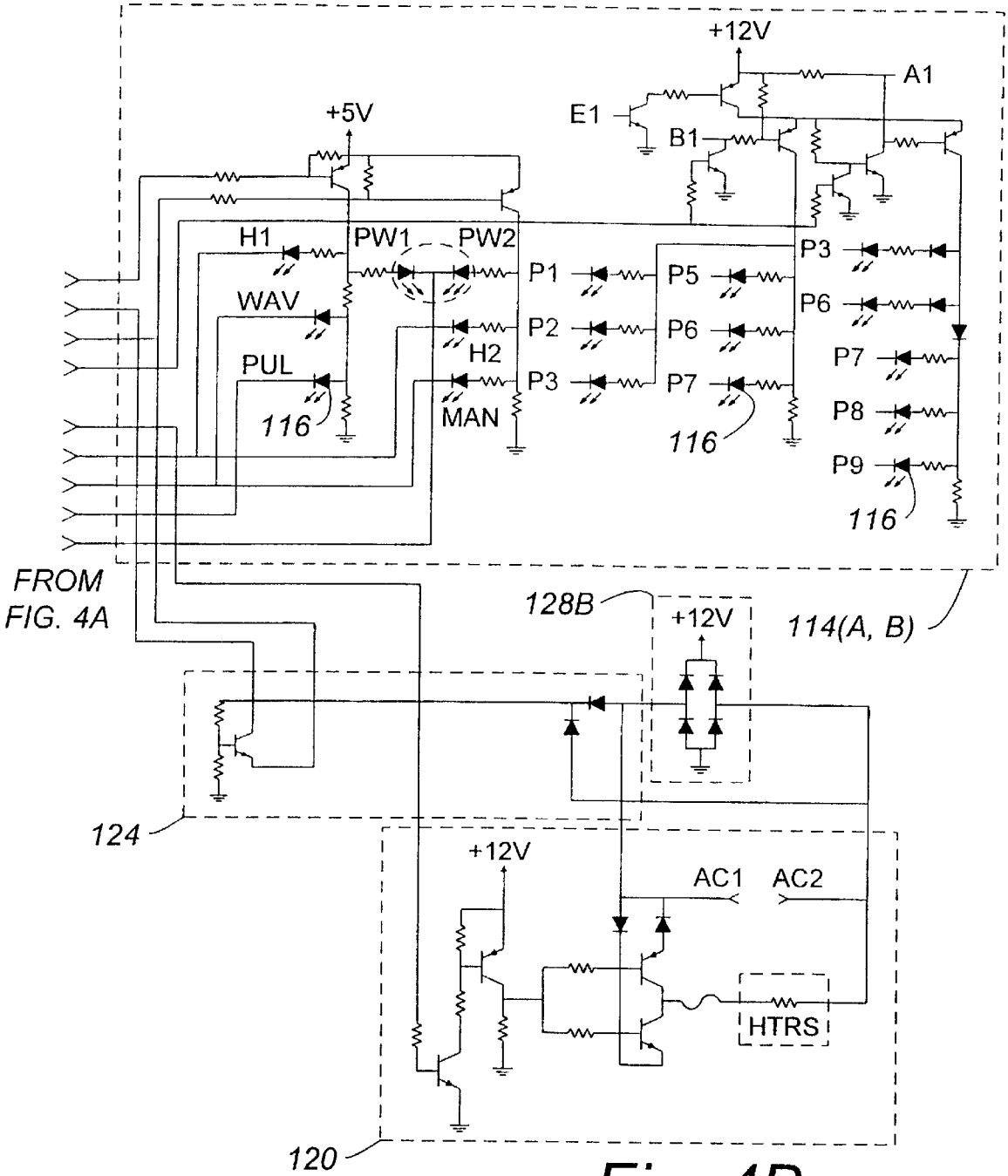

FIG. 4 (presented on separate sheets as FIGS. 4A and 4B) is a circuit diagram detailing the controller portion of FIG. 2; and FIGS. 5–12 are flow charts of a microprocessor program of the system of FIG. 1.

DESCRIPTION

Accordingly, as illustrated in FIGS. 1 and 2, the present invention comprises a microcontroller based massage system 10 utilizing a plurality of vibrators 12 that are embedded in a massage pad 14 upon which a user lies or reclines. Each vibrator 12 is of conventional construction, and may comprise a small DC motor that rotates an eccentric weight, or if desired, a pair of eccentrics at opposite ends of the motor, the vibrators 12 being sometimes referred to herein as motors. Thus the vibrator 12 is caused to vibrate as the eccentric weight rotates. It will be understood that other forms of vibrators may be used. The pad 14 may also contain embedded heaters 16 and 18 for enhanced massaging. The pad 14 may be divided into foldable sections such as an upper section 20 (upper and lower back), a middle section 22 (hips and thighs), and a lower section 24 (calves).

In the exemplary configuration shown in FIG. 1, the pad 14 is body length, having twelve vibrators 12 arranged in groups of two and three motors in five zones, as follows: (1) a first zone 26 for the left side, center, and right side of the shoulder area; a second zone 28 for the left side, center, and right side of the lower back; a third zone 30 for the left and right hips; a fourth zone 32 for the left and right thighs; and a fifth zone 34 for the left and right calves. Typically, the heaters 16 and 18 are centrally located in the shoulder and lower ack areas 26 and 28. It will be understood that other groupings and numbers of zones are contemplated.

The system 10 is activated via a remote control device or wand 36 containing push buttons or keys and visual status indicators, as more fully described below. The wand 36 is removably coupled to the massage pad via a cable 38, such as by a plug and socket coupling 40. The wand 36 and the massage pad 14 are powered from either a wall transformer through an electric cord 42 or a battery, the latter affording portable operation. The control wand 36 provides a variety of functions or modes which are performed through the manipulation of buttons, keys or equivalent means, with corresponding light to designate the selected function.

In some modes of operation, several of the buttons act as double or triple action keys, as further described herein. Specifically, as depicted in FIG. 2, power is turned on or off by a "PWR" button 44 centered within an area 46 designed "MASSAGE" and, when power is supplied, a light-emitting diode (LED) 48 is illuminated. The PWR or power button 44 also acts as a triple action key for selecting massage duration and test modes, described below. The five zones 26–34 are individually actuable by pressing corresponding buttons 50, 52, 54, 56 and 58 within a "ZONES" area 60. Visual status indications can be obtained by respective light being disposed below or adjacent corresponding buttons or keys. The heaters 16 and 18 are operable at two levels, for example by respective "HI" and "LO" heat buttons 62 and 64, within "HEAT" area 66, with corresponding status indications by illumination of respective LEDs 68 and 70 that are adjacent the buttons 62 and 64. The buttons 62 and 64 are also sometimes referred to as upper and lower heater buttons, because they can also act as triple action keys, sequentially selecting heat levels separately for the heaters 16 and 18 as described below.

The WAVE, PULSE AND SELECT operational modes are provided by pressing respective buttons 72, 74 and 76, all enclosed within a modes area 78, SELECT being synonymous with manual operation. Special effects are obtained through manipulation of buttons 82, 84, 86, 88, 90 and 92, in a "SENSATIONS" area 80, respective LEDs 94 being positioned respectively to represent the six vibrators 12 in the first and second zones 26 and 28. Similarly, "INTENSITY" and "SPEED" adjustments are provided by the pressing of respective toggle switch buttons 96 and 98 within a common area 100. The operations or effects of the various buttons of the wand 36 are described below.

Operation Modes

Operation is effected in several modes, viz., manual, wave, pulse, and special effects. In the manual mode, effected by pressing SELECT button 76, the vibrators 12 in enabled massage zones 26–34 run continuously. The user may enable and disable the zones and adjust the massage intensity. In the wave mode (WAVE button 72), the enabled massage zones 26–334 are cycled sequentially from first (26) to fifth (34) and back to first, and so forth. The user may enable and disable zones, adjust the massage intensity and adjust the cycling speed. In the pulse mode (PULSE button 74), the enabled massage zones are simultaneously pulsed on and off. The user may enable and disable zones, adjust the massage intensity, adjust the pulsing speed and set the pulse on/off ratio, for example, to 50/50. Other ratios may be selected by design, with more than one ratio being effected by multiple presses of the pulse key 74.

In the special effects mode (buttons 82–92), preset combinations of the six motors in the first and second zones 26 and 28 are selected for alternate action as follows, where the open and closed circles on keys 82–92 indicate how the zones alternate:

- For key 82, zone 1 left and zone 2 right alternating with zone 1 right and zone 2 left;
- For key 84, zone 1 left and right alternating with zone 1 center;
- For key 86, zones 1 and 2 left alternating with zones 1 and 2 right;
- For key 92, zone 2 left and right alternating with zone 1 center;
- For key 90, zone 2 left and right alternating with zone 2 center; and
- For key 88, zone 1 left and right alternating with zone 2 center.

The user may adjust the massage intensity and the alternating speed, and may also select audio intension control for each mode.

Function Keys

The function keys are in three major groups, namely selector, control, and mode. The selector keys include the power button 44, the upper and lower heater buttons 62 and 64, and the five zone buttons 50–58. More specifically, the selector keys are used to turn on and off the massage and heater functions and select which massage zones are active. These are multiple action keys that cycle to the next of two or three operating states on successive pressings.

The control keys include the up/down intensity buttons 90 (labeled "+" and "−"), the up/down speed buttons 98 (labeled "+" and "−"), and the fade and audio buttons 102 and 104. These keys are used to control the massage intensity and the operating mode speeds.

The mode keys include the SELECT or manual button 76, the wave button 72, the pulse button 74, and the six special effects buttons 82–92. The mode keys are used to select the current massage operating mode.

Regarding the specific selector keys, the power button 44 is a triple action key that cycles massage power through the states of "off", "on for 15 minutes" and "on for 30 minutes". The LED 48 is preferably bi-color for facilitating indication of the current massage power state. When an "on" state is selected, the massage system 10 will automatically turn off after operating for the selected time period.

The heat button 62 acts as a triple action key for cycling the upper heater 16 through the states of "off", "on low" and "on high". The LED 68 indicates the "on" states by periodically flashing off in the low state and staying on steady in the high state. When an "on" state is selected, the heater 16 will automatically turn off after 30 minutes. When the unit is configured for a single heater, the button 62 becomes the "high heat" key. In this mode it has a dual action selecting between the "off" and "on high" states and interacting mutually exclusively with the "low heat" key described below. The heater and massage power keys operate independently of each other. The lower heater 18 is operated similarly as heater 16, using the other heat button 64. When the unit is configured for a single heater, this button 64 becomes the "low heat" key. In this mode, the button 64 has a dual action selecting between the "off" and "on low" states and interacting mutually exclusively with the "high heat" key (button 62) described above.

The five buttons 50–58 act as dual action keys for enabling and disabling operation of the left and right vibrators 12 in the respective massage zones 26–34. Visual indicators associated with each key can be activated when the corresponding zone is enabled. The massage action produced by the enabled motors is determined by the currently selected operating mode.

Regarding the control keys, the intensity buttons 96 are a pair of individually operated or toggled keys that increase and decrease, respectively, the intensity of the massage. Briefly pressing and releasing either key will change the intensity setting to the next step. Pressing and holding either key will continuously change the setting until the key is released or the upper or lower limit is reached. Since the intensity of the massage provides feedback to the user, there are no visual indicators associated with these keys.

The speed buttons 98 are a pair of individually operated or toggled keys increase and decrease, respectively, the speed at which certain of the operating modes change the massage action. Briefly pressing and releasing either key will change the speed setting to the next step. Pressing and holding either key will continuously change the setting until the key is released or the upper or lower limit is reached. Since the speed at which the massage action changes provides feedback to the user, there are no visual indicators associated with these keys.

The fade button 102 is a dual action key that enables or disables the fade in/out function. When disabled, changes in the motor state (on-to-off or off-to-on) are abrupt. When enabled, the change occurs gradually over a short period of time, overlapping the stopping action of the vibrators 12 currently active in a particular zone with the starting action of the vibrators 12 in next zone to be activated, thus producing a smooth transition. Since the way in which the vibrations provides feedback to the user, there is no visual indicator associated with this key.

The audio button 104 is a dual action key that enables or disables intensity control from an external audio source. When disabled, motor intensity is controlled exclusively by the intensity keys 96. When enabled, motor intensity is controlled by an amplitude envelope of the signal from the audio source, up to a maximum level as set by intensity key 96. Since the way in which the motor intensity changes provides feedback to the user, there is no visual indicator associated with this key.

Regarding the mode keys, when the select or manual mode button 76 is operated, the associated visual indicator is activated, and the zone buttons 50–58, the intensity buttons 96, and the audio button 104 are operative for customizing the massage action. Pressing manual button 76 terminates any previous operating mode.

When the wave mode button 72 is operated, the associated visual indicator is activated, and the speed and fade buttons 98 and 102 aor operative, in addition to the zone buttons 50–58, the intensity buttons 96, and the audio button 104, for customizing the massage action. Pressing wave button 72 also terminates any previous operating mode.

When the pulse mode button 74 is first operated, the on/off duty cycle is set to 50/50. Pressing the pulse key again changes the duty cycle to 20/80 to provide a "tapping" sensation. Repeated pressings alternate between the 50/50 and 20/80 settings. The associated visual indicator is activated in the pulse mode. The zone, intensity, speed, fade and audio keys (buttons 50–58, 96, 98, 102 and 104) may be used to customize the massage action. Pressing the pulse key 74 terminates any previous operating mode.

When any of the six special effects buttons 82–92 are operated for selecting a corresponding special effect mode, the intensity, speed, fade and audio buttons 96, 98, 102 and 104 may each be used to customize the massage action. The special effects buttons are mutually exclusive, allowing only one special effect mode at a time, any previously selected zone or mode also being disabled until one of the manual, wave or pulse keys is pressed. Visual indication of activation of each vibrator 12 in the first and second zones 26 and 28 is provided by corresponding one of the LEDs 94. The visual indicators associated with the zone keys are disabled during the special effects modes.

Pressing the manual, wave or pulse key while in a special effect mode starts the new mode with the last combination of selected zones re-enabled. Pressing a zone key while in a special effect mode automatically enables the selected zone in manual mode. Any other previously enabled zones are disabled.

System Architecture

Figure 3:
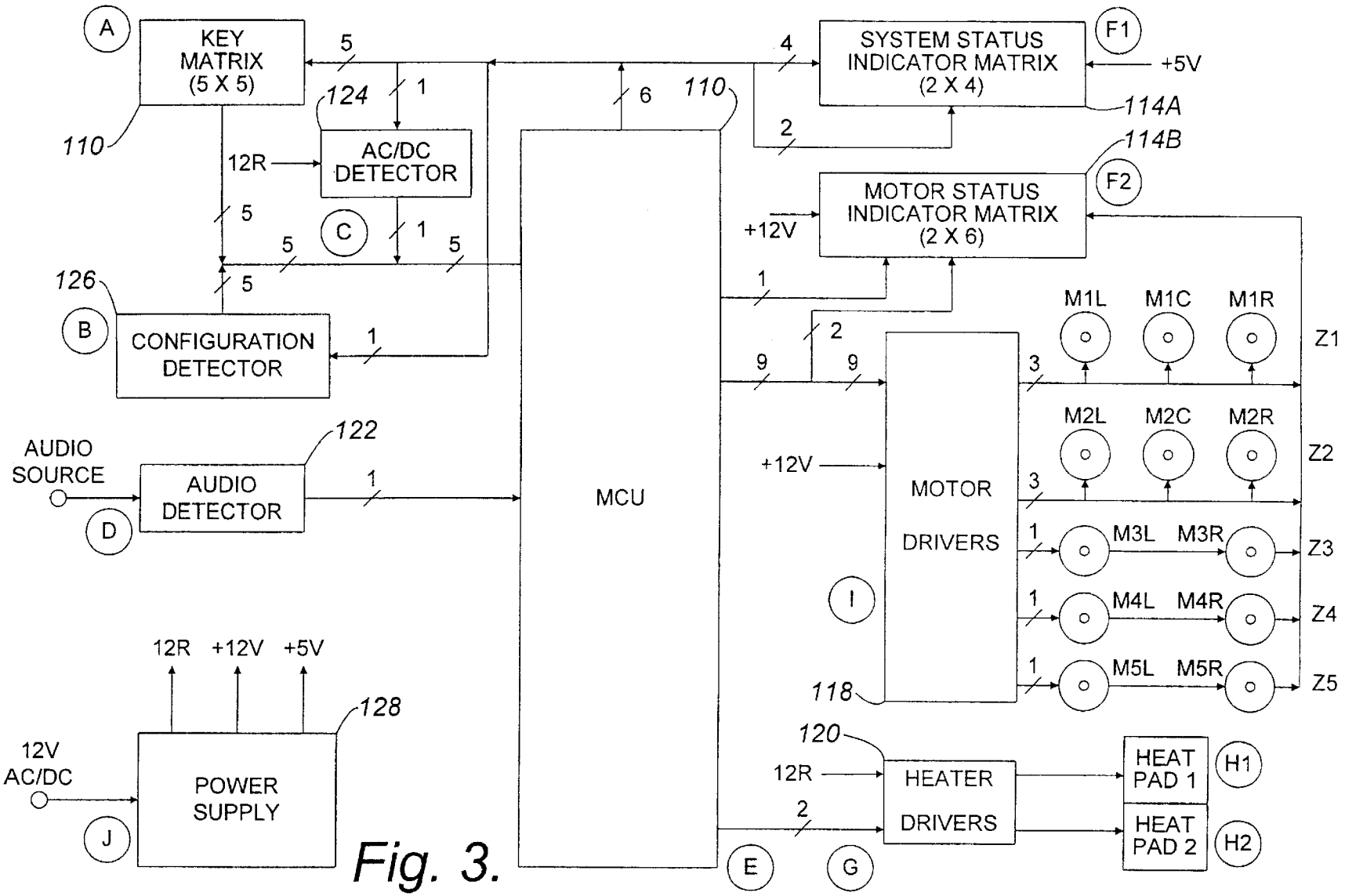
FIG. 3 is a block diagram of the system of FIG. 1.

Referring to FIGS. 3 and 4, the control architecture of the massage system 10 is based on a microcontroller (MCU) 110 in the wand 36, e.g., a 4-bit KS57P0002-01 chip manufactured by Samsung Electronics. The functional blocks shown in FIG. 3 and the corresponding circuit diagram of FIG. 4 include a KEY MATRIX 112, its 23 keys being electronically wired in a 5-by-5 matrix that is periodically scanned by the MCU chip 110. The scanning algorithm uses leading edge detection with trailing edge filtering or debouncing. This provides rapid response to key pressings and eliminates multiple pressing detection due to slow contact closure or contact bounce. Without this feature, the alternate action selector keys might jitter on and/or off as each key was pressed or released. The scanning algorithm also looks for multiple key pressings and ignores any condition where two or more keys appear simultaneously pressed. This is required to eliminate "phantom key" detection caused by electrical shorting of the rows and columns of the matrix as certain combinations of keys are pressed. This key arrangement and scanning algorithm advantageously reduces the number of MCU input/output pins required to detect key pressings. Other key arrangements and scanning algorithms are also usable; however, the matrix approach is the most economical in terms of MCU resources. Any unused key positions in the matrix are reserved for future enhancements.

Also connected to the MCU are indicators in a 2-by-4 system status matrix 114A and a 2-by-6 motor status matrix 114B. The system status matrix 114A contains the power, heater and mode indicators, while the motor status matrix 114B contains the zone and special effect indicators. The system status matrix 114A is driven in a multiplexed fashion by MCU 110, each "column" of 4 LEDs being activated for about 49% of each display cycle. The period of the complete display cycle is short enough so that all activated indicators appear fully illuminated without any noticeable flicker. Flashing of selected indicators is a function performed by the control firmware independent of the display cycle.

The motor status matrix 114B has one column of LEDs for the zone modes (select, wave and pulse) and another for the special effect mode. The columns are driven mutually exclusively depending on the currently selected operating mode by logically combining idle motor drive signals with an enable signal from the MCU. LEDs within the selected column are activated by their associated motor drivers. The duty cycle is set to 16% so that variations in motor speeds generated by the PWM process, described below, do not cause variations in LED intensity.

The status indicator matrices 114A and 114B in combination with associated programming of the MCU advantageously reduces the number of MCU output pins required to illuminate the indicators. To further conserve MCU resources, the six drive signals of the system status matrix are shared with the key matrix 112. During the 2% of the display cycle when the display is inactive, five of the signals are used to scan the rows of the key matrix. The sixth signal is used as described below in a configuration selector 126 to identify particular components present in the system 10 upon power-on. Other visual indicator arrangements and driving algorithms are also possible; however, the matrix approach is the most economical in terms of MCU resources.

An array of motor drivers 118 are directly driven from individual MCU output ports. Massage intensity (motor speed) is controlled by pulse width modulation (PWM) of the signals applied to the drivers 118. This, in turn, controls the average power applied to the motor. While a duty cycle range of 0–100% is possible, other factors limit the range to about 16–98%. These factors include motor stalling at low speeds, and subjective evaluation of minimum and maximum intensity levels. To reduce the audible noise generated by the PWM process, the modulation frequency is set to approximately 70 Hz.

A heater driver circuit 120 includes heating pad drivers that are directly operated from individual MCU output ports. Heat level is controlled by pulse width modulation of the signal applied to the driver in the same manner as for the motor drivers. For high heat, the duty cycle is set to 100%. For low heat, the duty cycle is set to 100% for a warm up interval and then is reduced to 60%. The warm up interval ranges from 0 to 5 minutes depending on the amount of time the heater was previously off. The heating pads contain integral thermostats that limit the maximum operating temperature.

An audio detector 122, for connection to an external source of audio signals, is implemented as a fast-attack/slow-decay peak detector for sensing the amplitude envelope of the external source. Using a programmable analog comparator contained within the MCU 110, the firmware measures the envelope voltage at the output of the detector and scales the reading to a 0–100% value. The firmware then multiplies this value by the current intensity control value to generate an actual intensity control value used by the motors.

The massage system 10 is contemplated to be operated from a variety of electrical power sources, some of which can affect or impose restrictions on performance of the system. For example, one typical source is an AC line in combination with a low voltage transformer having limited available current and significant voltage drop as loads are applied, another contemplated source being an automobile electrical system. When the system is operated on DC being from an automobile storage battery, the current is not significantly limited and there is little or no voltage drop as loads are applied (such as by changing the number and duty cycle of the vibrators 12 being activated). Accordingly, the system 10 has a power source detector 124 that enables the MCU firmware to determine whether the system 10 is operating from an AC power source, to effect appropriate modification of driver activations by the MCU. The detector 124 is enabled and sensed once immediately following power-on. Under AC operation the available power is limited by the size of the transformer and the firmware must control the maximum power used by the motors, as described below with respect to the power control algorithm. Under DC operation, which is normally from an automobile storage battery, the system assumes that there is no limit to the power available; thus there is no constraint placed on the power to the motors. It will be understood that other combinations of power source limitations can exist, and appropriate detection of particular sources can be used to produce suitable modifications to driver activations.

A configuration selector 126 is also connected between the MCU and the key matrix 112 permit the firmware to determine the type of product in which the MCU is installed. This allows a variety of different systems to be configured, with each system containing unique combinations of the various features described herein. The selector 126 includes an array of 5 diodes that share the column data lines from the key matrix. The diodes are enabled and sensed once immediately following power-on. The information returned by the selector 126 specifies the physical key, visual indicator, motor and heater configuration in the actual product. The MCU firmware uses this information to modify the way in which it interacts with the user.

A power supply unit 128, including portions 128A and 128B feeds the various components of the system 10 from either an AC wall transformer or a DC battery supply. The operating voltage is nominally 12 V RMS AC or 12–14 V DC. The heaters 16 and 18 are driven directly from the power source using a non-polarized saturated transistor switching circuit. The power source is also fed to a full-wave bridge rectifier to create an unregulated 12 VDC (12–18 VDC from an AC supply). The unregulated DC supply is used to drive the motors and power a 5 V regulator for the MCU and logic circuitry.

Regarding the control programming of the MCU 110, the power control, speed control, default conditions, and a test mode of the present invention are more fully described below.

The power control: When operating from an AC transformer, the power available to drive the motors and heaters is limited by the maximum rating of the transformer. In addition, the rectified but unregulated DC voltage used to drive the motors varies according to the number of motor loads. With only one motor enabled, the DC voltage is closer to the AC peak value. As more motors are enabled, the DC voltage drops to near the AC RMS value.

For AC operation, an appropriate transformer allows all motors to operate at full power without heaters and, with one or two heaters activated, allows reduced motor power, the transformer output power being preferably selected according to the number of heaters present in the system 10. The power control algorithm for AC operation is described in the following steps.

(a) At beginning of each PWM (pulse width modulation) period, the MCU 110 computes the maximum (100% intensity) duty cycle as a function of the number of motors enabled. The value is set to 48% plus 10% if a heater is enabled and 4% for each motor enabled. The incremental factors compensate for the DC voltage drop as loads are added.

(b) Next, an upper limit is selected. If no heaters are enabled, the limit is set to 99% minus 1% for each enabled motor. If a heater is enabled, the limited is set to 65% minus 1% for each enabled motor. The reduction factor compensates for added transformer loading.

(c) The maximum duty cycle is compared to the limit. If it is greater than the limit, it is reset to the limit value.

(d) The minimum PWM duty cycle, 16%, is subtracted from the maximum value and the result is multiplied by the intensity control value (0–100%). The minimum duty cycle is added back to the scaled result to obtain the actual duty cycle fort the current PWM period.

For DC operation, the heater and DC motor voltages are assumed to be essentially contact regardless of the load. The power control algorithm sets the maximum duty cycle to 99% and executes only Step (d) immediately above.

The speed control: The speed keys 98 adjust the step period for certain operating modes. Due to the manner in which speed changes are observed, the amount by which the step period is adjusted for each pressing of the SPEED key is a percentage of the current step period rather than a constant value. The percentage amount, P, is computed as the Nth root of R where R is the period range (maximum period minus minimum period) and N is the number of "SPEED" key steps allowed over R. Thus the step period change for each SPEED key pressing becomes ±S*P/100 where S is the current step period.

The default conditions: When power is applied to the unit, the operating states are set as follows:

(a) Massage and heater power are set off;

(b) Zone 1 is selected in manual mode;

(c) Intensity is set to 60%;

(d) Speed is set to one second per step; and (e) Fade and audio are disabled.

When the unit is turned on with massage power key 44, the previously selected zones, operating mode, intensity, speed, fade and audio states are retained. The massage timer, however, is reset to 15 minutes.

The test mode: The test mode is an automatic sequence of functions to test and/or demonstrate the capabilities of the unit. The procedure to evoke it and the functions it performs are as follows.

For evoking the test mode, the key entry sequence is (1) to press the POWER key, if necessary, until massage power is off (POWER visual indicator off) and (2) to press the INTENSITY UP key followed, within 1 second, by the SPEED DOWN key. At this point the POWER visual indicator rapidly flashes between red and green for 3 seconds. Pressing the POWER key during this interval starts the test mode. All other keys have their normal functions.

The test mode produces a sequence of functions, each test function executing for one or more test steps, a time period of each step being determined by the SPEED key. The SPEED and INTENSITY keys are active during test mode and may be used to alter the test speed and motor intensity, respectively. The test mode starts with all motors and visual indicators off and, while this sequence can be terminated at any time by pressing power key 44, it proceeds as follows:

| | |
|---|---|
| (1) | POWER visual indicator on green; |
| (2) | POWER visual indicator on green |
| (3) | For one heater unit:<br>(a) LOW HEAT visual indicator and low heater on; and<br>(b) LOW HEAT visual indicator off and HIGH HEAT visual indicator and high heat on; or |
| (4) | For two heater units:<br>(a) UPPER HEATER visual indicator and high heat on;<br>(b) UPPER HEATER visual indicator and heater off, LOWER HEATER visual indicator and high heat on; and<br>(c) UPPER HEATER and LOWER HEATER visual indicators and high heat on; |

-continued

| | |
|---|---|
| (5) | MANUAL visual indicator on; |
| (6) | ZONE 1 visual indicators and motors on, followed in successive test steps by zones 2 through 5; |
| (7) | MANUAL visual indicator off, all zone indicators and motors off, PULSE indicator on; |
| (8) | Pulse function executed for two cycles (four steps) ending with all zone visual indicators and motors off; |
| (9) | PULSE visual indicator off, WAVE visual indicator on and ZONE 1 visual indicator and motors on; |
| (10) | Wave function executed for eight steps. WAVE visual indicator and all zone visual indicators and motors are turned off at the end of this sequence; |
| (11) | Special effects 1 through 6 executed in succession for two cycles (four steps) each; |
| (12) | Zone and special effects visual indicators and motors off; |
| (13) | Heat visual indicators and heaters off; and |
| (14) | All visual indicators off. |

The test sequence ends with the massage and heater power off, and the unit may then be operated normally.

Firmware

Reference is now directed to FIGS. 5–12 which depict the flow charts or diagrams that describe the operation of the firmware of the present invention. The description and operation are divided into three sections, architecture, mainline modules and timer interrupt modules, in which "Y" and "N" respectively mean "yes" and "no" and "SE" means "special effects."

Architecture: The firmware is divided into a set of mainline and timer interrupt modules. The mainline modules have direct control of the massage portion of the device. They sense key pressings and change the massage operation as a function of the current operating mode. The timer interrupt modules perform all of the time dependent sense and control tasks requested by the mainline modules plus processing of power, heater, intensity and speed key pressings. The mainline and interrupt modules execute in an interlaced fashion with the latter preempting the former whenever a timer interrupt occurs. Communication between the two is via RAM flags and control words.

Mainline Modules

Figures 5, 6:
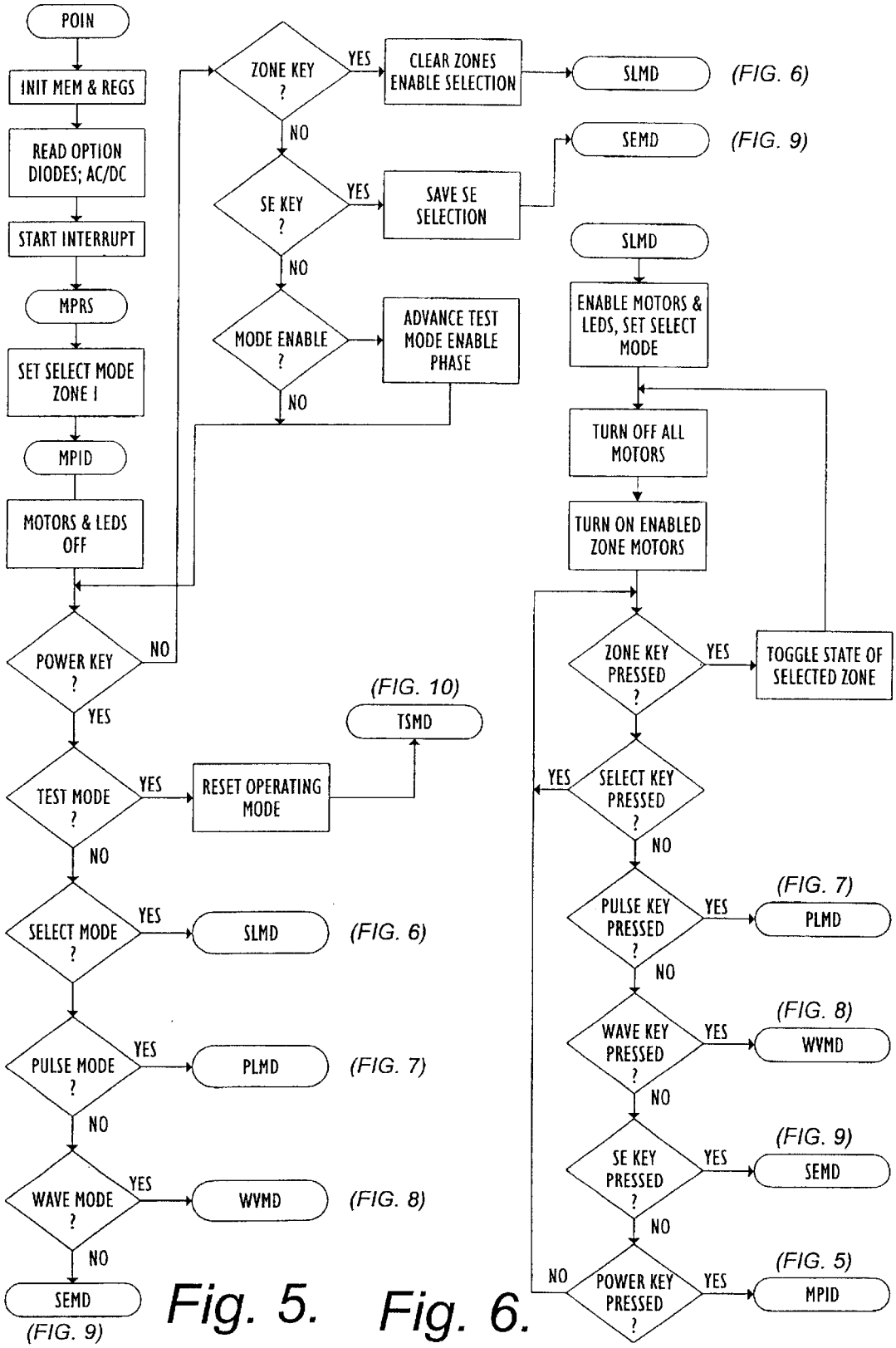

The names and functions of the mainline modules described in the flow charts in FIG. 5 are as follows:

Power-On Initialization (POIN) (FIG. 5). Executes once following application of the power key 44 to the device to initialize hardware registers, initialize RAM contents, read the option diodes, test for an AC or DC power supply and then start the timer interrupt module.

Massage Power Rests (MPRS) (also FIG. 5). Initializes the unit into Select Mode with Zone 1 enabled. Executed following POIN and TSMD (described below).

Massage Power Idle (MPID) (also FIG. 5). Executes when the massage power is off to sense key pressings that would turn the massage on. These include POWER (key 44), ZONE 1–5 (keys 50–58), SPECIAL EFFECTS (keys 82–92) and the two key sequences that enable the POWER key to turn the unit on in test mode.

Select Mode (SLMD) (FIG. 6). Executes when the unit is in Select Mode to run the selected zone motors and sense key pressings. The ZONE 1–5 keys toggle the state of the zones and the PULSE, WAVE and SPECIAL EFFECT keys (keys 74, 72, and 82–92, respectively) transfer execution to the appropriate module.

Figure 7:
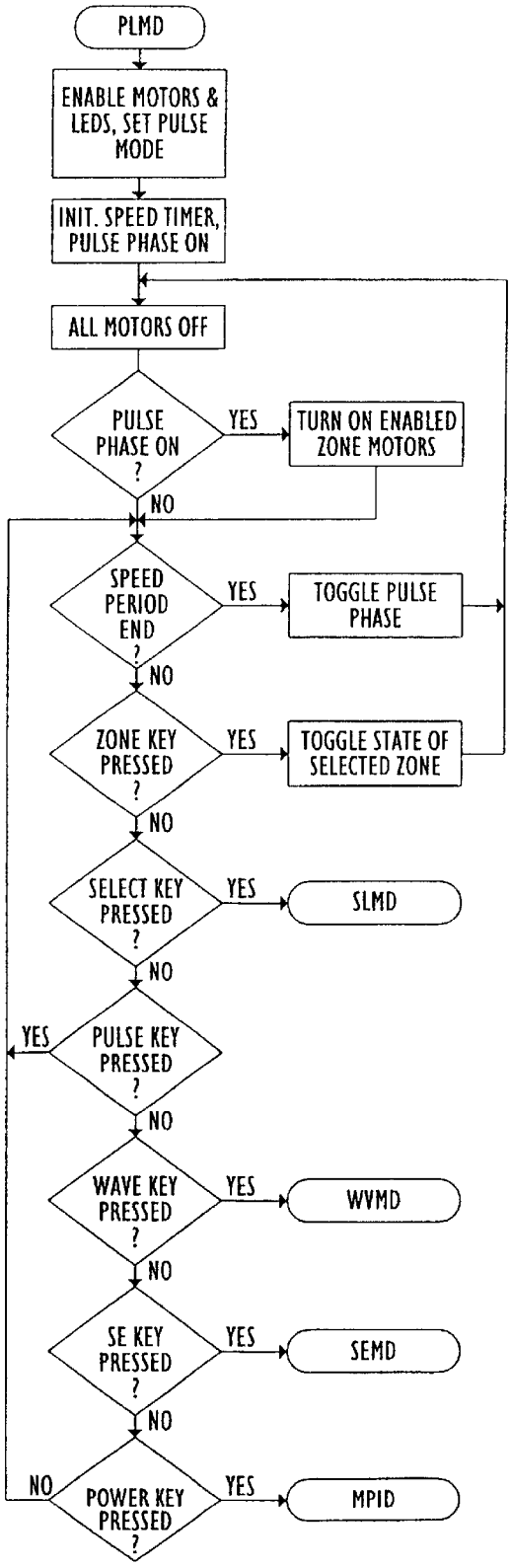

Pulse Mode (PLMD) (FIG. 7). Executes when the unit is in Pulse Mode to pulse the selected zone motors and sense key pressings. The ZONE 1–5 keys toggle the state of the zones and the SELECT, WAVE and SPECIAL EFFECT keys (keys 76, 72 and 82–92, respectively) transfer execution to the appropriate module.

Figure 8:
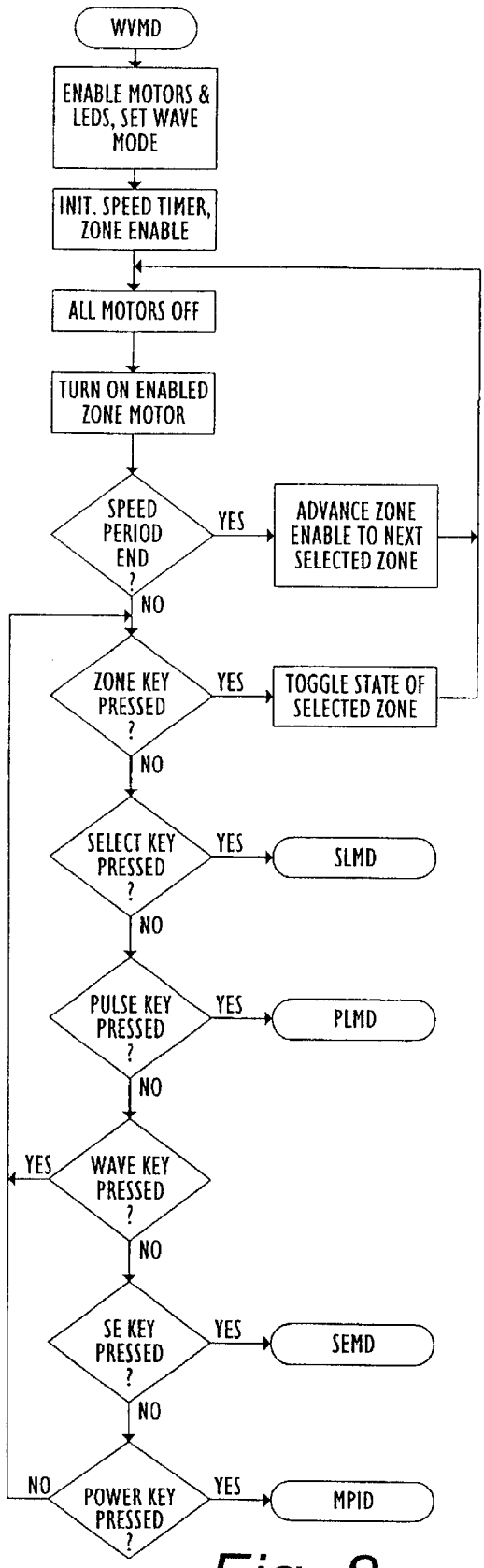

Wave Mode (WVMD) (FIG. 8). Executes when the unit is in Wave Mode to run the selected zone motors in wave fashion and sense key pressings.

The ZONE 1–5 keys toggle the state of the zones and the SELECT, PULSE and SPECIAL EFFECT keys transfer execution to the appropriate module.

Figure 9:
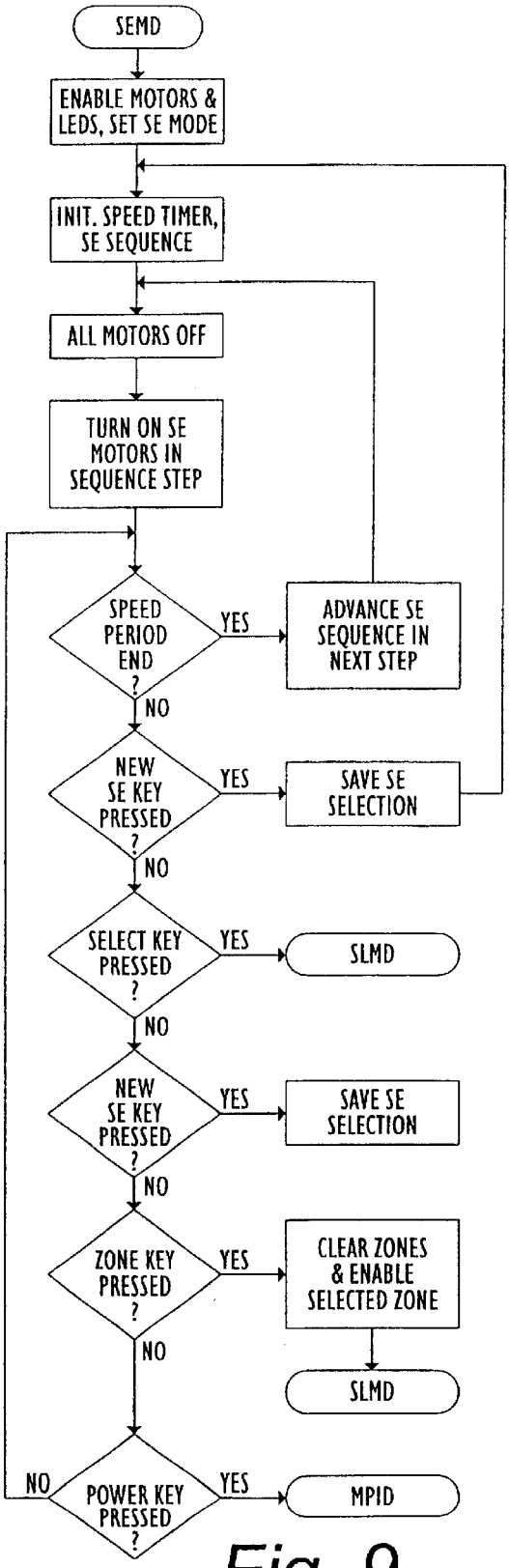

Special Effect Mode (SEMD) (FIG. 9). Executes when the unit is in Special Effect Mode to run the selected special effect sequence and sense key pressings. The SPECIAL EFFECT keys change the selected special effect. The ZONE 1–5 keys transfer to SLMD with the selected zone enabled, and the WAVE, PULSE and SELECT keys transfer to SVMD, PLMD and SLMD respectively with previously selected zones enabled.

Figure 10:
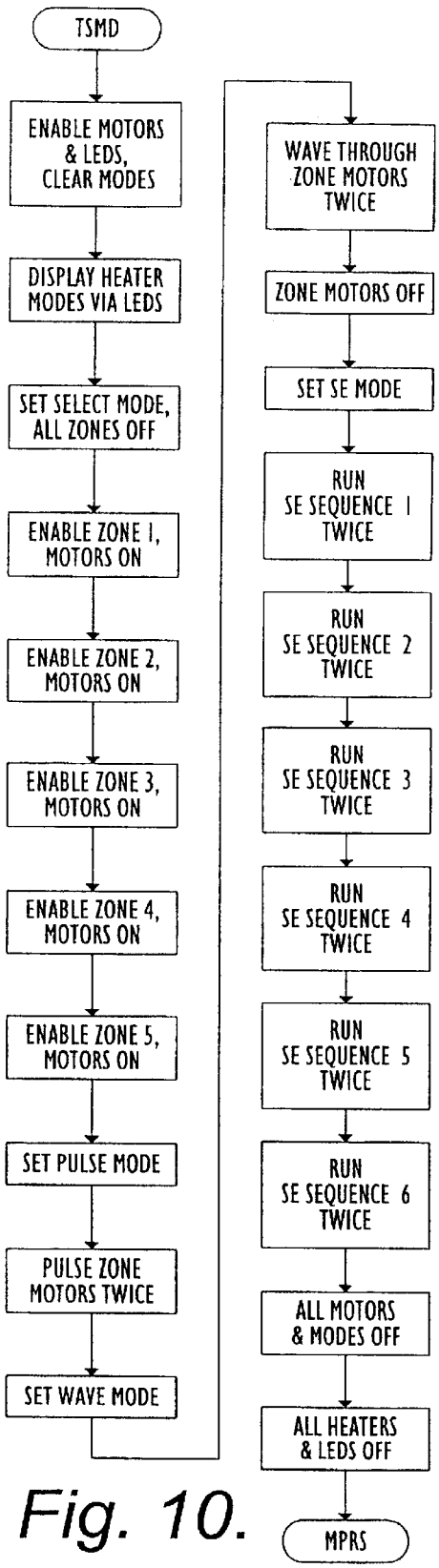

Test Mode (TSMD) (FIG. 10). Executes after the test mode enable key sequence is entered and POWER is pressed. The module tests the heaters, motors and LEDs by cycling through all combinations of the key enabled functions. When the test is complete, the massage and heaters are turned off and execution proceeds at MPRS.

Figure 11:
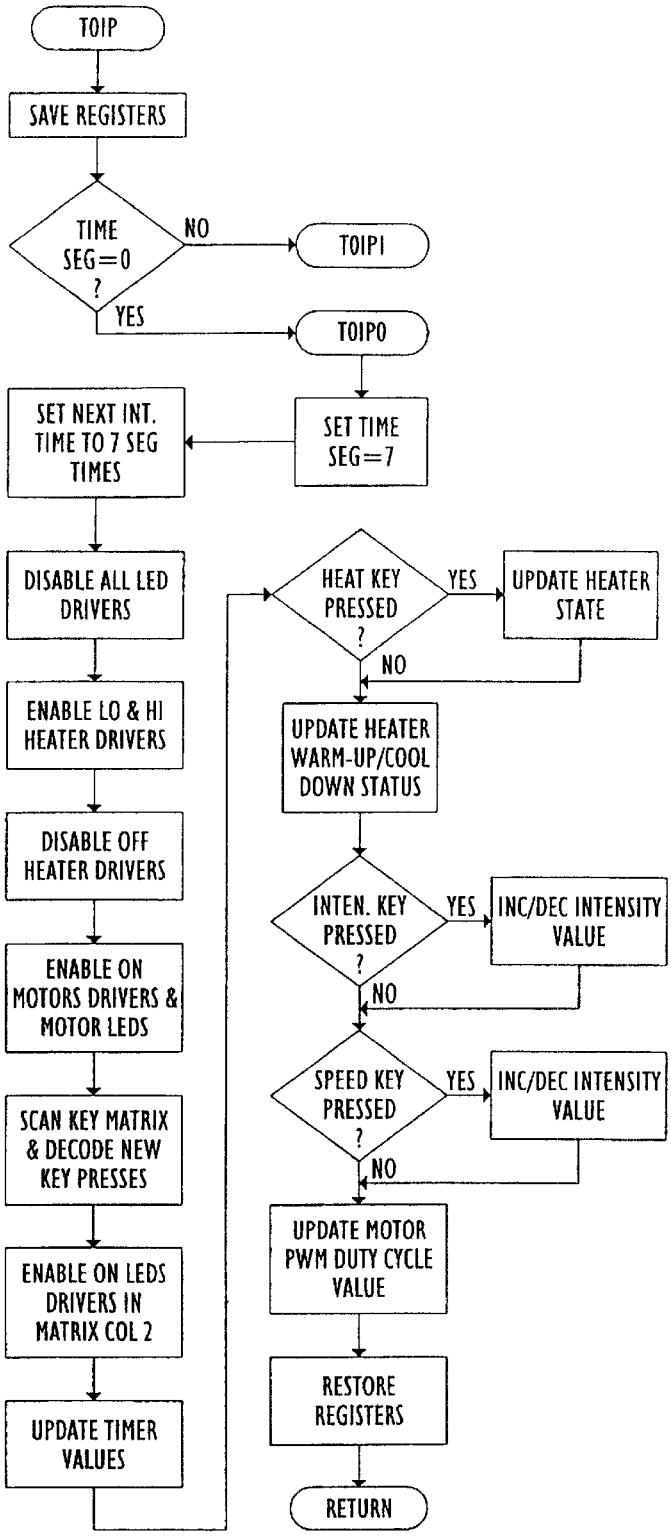

Timer Interrupt Modules: The timer interrupt modules define the 14,000 $\mu$s motor PWM (pulse width modulation) cycle. The PWM cycles is composed of 100 140 $\mu$s "time segments," each corresponding to a 1% duty cycle increment. Time segments are identified by a segment number stored in RAM. The first interrupt in the cycle is at the start of time segment 0. During this interrupt, once-per-cycle activities such as key matrix scanning and duty cycle recomputation are performed. The processor sets the next interrupt to occur 7 time segments later to allow additional time for processing. The next 93 interrupts occur at the beginning of times segments 7 through 99. The names and functions of the timer interrupt modules described in the flow charts are as follows:

1) Timer 0 Interrupt Processor (TOIP) (FIG. 11). Executes once upon the occurrence of each timer interrupt to save working registers and transfer to one of the other two modules as a function of the current time segment number.

2) Timer 0 Interrupt Processor 0 (TOIP0) (also FIG. 11). Executes during time segment 0 to process the once-per-cycle functions. Specific functions are as follows:

a) The timer is rest to interrupt at the start of segment 7 (980 $\mu$s later) and the time segment number is set to 7 for that interrupt.

b) All LED drivers are disabled.

c) The drivers for heaters on LOW or HIGH are enabled and the drivers for OFF heaters are disabled.

d) The drivers for ON motors are enabled.

e) The key matrix is scanned using a switch contract debouncing algorithm. Multiple key pressings are discarded and signal new key pressings are decoded and saved. If the POWER key was pressed, the current massage state and the power-on timer are updated.

f) The motor status LED driver for the selected operating mode is enabled. Only those LEDs associated with ON motors are illuminated.

g) The drivers for the ON LEDs in the system status LED matrix column 1 are enabled.

h) The massage power on timer, speed period timer, heater LED blink timer and heater warm-up/cool-down timer are updated.

i) If a heater key was pressed, the state for that heater is updated.

j) If an intensity key was pressed, the intensity value is incremented or decremented by 1.

k) If a speed key was pressed, the speed period value is incremented or decremented by 4% of its current value.

l) The motor PWM duty cycle is updated taking into account the number of motors running, the motor intensity level, the current heater status and the type of power supply. The new value is used in the current PWM cycle.

m) The working registers are restored, and control is returned to the interrupted mainline module.

Figure 12:
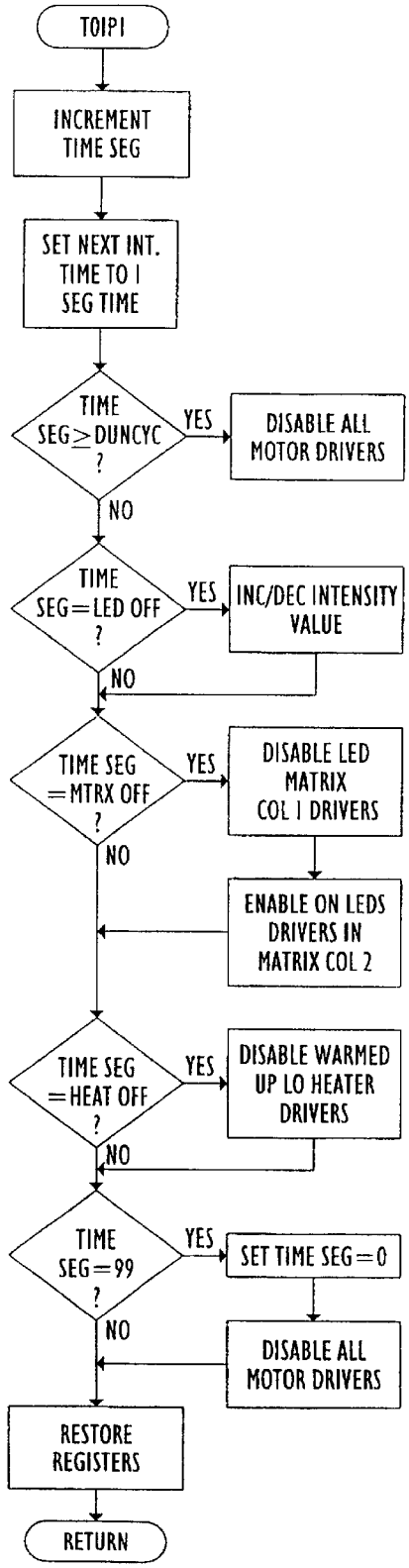

3) Timer 0 Interrupt Processor 1 (TOIP1) (FIG. 12). Executes during time segments 7 through 99 to process time segment dependent functions as follows:

a) The timer is reset to interrupt at the start of the next time segment (140 $\mu$s later) and the segment number is incremented by one for that interrupt.

b) If the current segment number is greater than or equal to the motor PWM duty cycle, the motor drivers are disabled.

c) If the current segment number is one of the following, the described function is performed.

i) For segment 16, the motor status LED driver is disabled;

ii) For segment 51, the drivers for system status LED matrix column 1 are disabled and those for the ON LEDs in column 2 are enabled;

iii) For segment 60, the drivers for heaters on LOW that have passed their warm-up time are disabled; and iv) For segment 99, the segment number is set to 0 and all motor drivers are disabled.

d) The working registers are restored and control is returned to the interrupted mainline module.

Although the present invention has been described in considerable detail with reference to certain preferred versions thereof, other versions are possible. For example, the system 10 can utilize separately settable intensity control values for each of the vibrators 12. Also, the test mode can be modified so that either the whole test or selected portions thereof are performed, either once or repeatably, in response to operator input. Therefore, the spirit and scope of the appended claims should not necessarily be limited to the description of the preferred versions contained herein.

Stanley Cutler, Gayle B. Gerth,
Alton B. Otis, Jr. and Taylor Chau -
"MICROCONTROLLER BASED MASSAGE SYSTEM"

APPENDIX A

Appendix A in hard copy print out of the assembly listing consisting of 45 pages.

This assembly listing is subject to copyright protection. The copyright owner has no objection to the reproduction of the patent disclosure, as it appears in the Patent and Trademark Office patent files or records, but otherwise reserves all copyright rights whatsoever.

COPYRIGHT © 1996 JB RESEARCH, INC. ALL RIGHTS RESERVED

BIGMAN WAND CONTROL PROGRAM (BGMNCP) Page 2
Assembly Listing

```
0000                    EJECT
0000            ;
0000            ;       MPU REGISTER ADDRESS PARAMETERS
0000            ;
0000            BTMDR   EQU 0F85H
0000            BTCTR   EQU 0F86H
0000            WTMDR   EQU 0F88H
0000            T0MDR   EQU 0F90H
0000            TMOER   EQU 0F92H
0000            T0CTR   EQU 0F94H
0000            T0RFR   EQU 0F96H
0000            INPRR   EQU 0FB2H
0000            PCONR   EQU 0FB3H
0000            I0MDR   EQU 0FB4H
0000            I1MDR   EQU 0FB5H
0000            I2MDR   EQU 0FB6H
0000            BTICR   EQU 0FB8H
0000            WTICR   EQU 0FBAH
0000            T0ICR   EQU 0FBCH
0000            SIICR   EQU 0FBDH
0000            EXICR   EQU 0FBEH
0000            KBICR   EQU 0FBFH
0000            BTSQR   EQU 0FC0H
0000            COMDR   EQU 0FD0H
0000            CPRSR   EQU 0FD4H
0000            CPMDR   EQU 0FD6H
0000            PUMDR   EQU 0FDCH
0000            SIMDR   EQU 0FE0H
0000            SIBFR   EQU 0FE4H
0000            P2MDR   EQU 0FE2H
0000            PMG1R   EQU 0FE8H
0000            PMG2R   EQU 0FEAH
0000            PMG3R   EQU 0FECH
0000            ;
0000            ;       MPU BIT ADDRESS PARAMETERS
0000            ;
0000            T0IRQ   EQU T0ICR.0
0000            T0IEN   EQU T0ICR.1
```

```
0000                    EJECT
0000            ;
0000            ;       INTERVAL TIMER PARAMETERS
0000            ;
0000            TØCYT   EQU 14
0000            TØSPT   EQU (TØCYT*1000)/(4*100)
0000            TØIUL   EQU 255/TØSPT
0000            TØTØP   EQU 2*TØCYT
0000            TØT2P   EQU 2
0000            ;
0000            ;       KEYBOARD SCAN PARAMETERS
0000            ;
0000            KBDBD   EQU 80
0000            KBKRD   EQU 100
0000            KBKPD   EQU 2000
0000            ;
0000            ;       MASSAGE CONTROL PARAMETERS
0000            ;
0000            MIDEP   EQU 16
0000            SIDSP   EQU 51
0000            MCTOD   EQU 130
0000            PWOT1   EQU 15
0000            PWOT2   EQU 30
0000            ;
0000            ;       HEAT CONTROL PARAMETERS
0000            ;
0000            HTCYP   EQU 60
0000            HTWUD   EQU 300
0000            HTOTD   EQU 30
0000            HTFDD   EQU 100
0000            HTFED   EQU 3500
0000            ;
0000            ;       RATE CONTROL PARAMETERS
0000            ;
0000            DFINL   EQU 61
0000            INCLL   EQU 8
0000            INCAL   EQU 48
0000            INCDL   EQU 99
0000            INCML   EQU 99
0000            INCHL   EQU 65
0000            INCHX   EQU 55
0000            INCLD   EQU 1
0000            INCMI   EQU 4
0000            INCHI   EQU 10
0000            INVLL   EQU 64
0000            INVRI   EQU 4
0000            DFSPL   EQU 1000
0000            SPCLL   EQU 310
0000            SPCUL   EQU 3750
```

```
BIGMAN WAND CONTROL PROGRAM  (BGMNCP)                                  Page 4
Assembly Listing

 97  0000                    EJECT
 98  0000            ;
 99  0000            ;       TEST MODE PARAMETERS
100  0000            ;
101  0000            TSMSD   EQU 1000
102  0000            TSMED   EQU 3000
103  0000            ;
104  0000            ;       KEY CODE PARAMETERS
105  0000            ;
106  0000            KCT     EQU 1
107  0000            KPW     EQU (KCT*16)+0
108  0000            KHL     EQU (KCT*16)+2
109  0000            KHH     EQU (KCT*16)+3
110  0000            KMD     EQU 2
111  0000            KMN     EQU (KMD*16)+0
112  0000            KWV     EQU (KMD*16)+1
113  0000            KPL     EQU (KMD*16)+2
114  0000            KSE     EQU 3
115  0000            KE1     EQU (KSE*16)+0
116  0000            KE2     EQU (KSE*16)+1
117  0000            KE3     EQU (KSE*16)+2
118  0000            KE4     EQU (KSE*16)+3
119  0000            KE5     EQU (KSE*16)+4
120  0000            KE6     EQU (KSE*16)+5
121  0000            KEL     EQU (KSE*16)+6
122  0000            KZN     EQU 4
123  0000            KZ1     EQU (KZN*16)+0
124  0000            KZ2     EQU (KZN*16)+1
125  0000            KZ3     EQU (KZN*16)+2
126  0000            KZ4     EQU (KZN*16)+3
127  0000            KZ5     EQU (KZN*16)+4
128  0000            KRT     EQU 5
129  0000            KID     EQU (KRT*16)+0
130  0000            KIU     EQU (KRT*16)+1
131  0000            KSD     EQU (KRT*16)+2
132  0000            KSU     EQU (KRT*16)+3
```

```
0000                    EJECT
0000            ;
0000            ;       DATA MEMORY BANK Ø ASSIGNMENTS
0000            ;
0000                    ORG ØØØH
0000            ;
0000            ;       WORKING REGISTERS
0000            ;
0000            AREG    EQU $
0001                    ORG $+1
0001            EREG    EQU $
0002                    ORG $+1
0002            LREG    EQU $
0003                    ORG $+1
0003            HREG    EQU $
0004                    ORG $+1
0004            XREG    EQU $
0005                    ORG $+1
0005            WREG    EQU $
0006                    ORG $+1
0006            ZREG    EQU $
0007                    ORG $+1
0007            YREG    EQU $
0008                    ORG $+1
0008            ;
0008            ;       CONFIGURATION CONTROL FLAGS
0008            ;
0008            CFCF    EQU $
000A                    ORG $+(1*2)
000A            ;
000A            ;       MEMORY INITIALIZATION START ADDRESS
000A            ;
000A            MISA    EQU $
```

BIGMAN WAND CONTROL PROGRAM (BGMNCP) Page 6
Assembly Listing

```
000A                    EJECT
000A            ;
000A            ;       INTERVAL TIMER CONTROL FLAGS
000A            ;
000A            ITCF    EQU $
000C                    ORG $+(1*2)
000C            ;
000C            ;       INTERVAL TIMER CONTROL BUFFER
000C            ;
000C            ITCB    EQU $
0014                    ORG $+(4*2)
0014            ;
0014            ;       KEYBOARD CONTROL FLAGS
0014            ;
0014            KBCF    EQU $
0016                    ORG $+(1*2)
0016            ;
0016            ;       KEYBOARD CONTROL BUFFER
0016            ;
0016            KBCB    EQU $
001C                    ORG $+(3*2)
001C            ;
001C            ;       KEYBOARD DATA BUFFER
001C            ;
001C            KBDB    EQU $
0020                    ORG $+(2*2)
0020            ;
0020            ;       POWER CONTROL FLAGS
0020            ;
0020            PWCF    EQU $
0022                    ORG $+(1*2)
0022            ;
0022            ;       POWER CONTROL BUFFER
0022            ;
0022            PWCB    EQU $
0026                    ORG $+(2*2)
0026            ;
0026            ;       HEATER CONTROL FLAGS
0026            ;
0026            HTCF    EQU $
002A                    ORG $+(2*2)
002A            ;
002A            ;       HEATER CONTROL BUFFERS
002A            ;
002A            H1CB    EQU $
0030                    ORG $+(3*2)
0030            H2CB    EQU $
0036                    ORG $+(3*2)
0036            ;
0036            ;       MOTOR CONTROL FLAGS
0036            ;
0036            MTCF    EQU $
003A                    ORG $+(2*2)
```

BIGMAN WAND CONTROL PROGRAM (BGMNCP) Page 7
Assembly Listing

```
003A                    EJECT
003A            ;
003A            ;       OPERATING MODE CONTROL FLAGS
003A            ;
003A            OMCF    EQU $
003C                    ORG $+(1*2)
003C            ;
003C            ;       ZONE CONTROL FLAGS
003C            ;
003C            ZNCF    EQU $
003E                    ORG $+(1*2)
003E            ;
003E            ;       ZONE SELECT CONTROL BUFFER
003E            ;
003E            ZSCB    EQU $
0040                    ORG $+(1*2)
0040            ;
0040            ;       SPECIAL EFFECTS CONTROL BUFFER
0040            ;
0040            SECB    EQU $
0042                    ORG $+(1*2)
0042            ;
0042            ;       PULSE CONTROL FLAGS
0042            ;
0042            PLCF    EQU $
0044                    ORG $+(1*2)
0044            ;
0044            ;       SPEED CONTROL BUFFER
0044            ;
0044            SPCB    EQU $
0048                    ORG $+(2*2)
0048            ;
0048            ;       INTENSITY CONTROL BUFFER
0048            ;
0048            INCB    EQU $
004C                    ORG $+(2*2)
004C            ;
004C            ;       TEST CONTROL FLAGS
004C            ;
004C            TSCF    EQU $
004E                    ORG $+(1*2)
004E            ;
004E            ;       PROGRAM STACK AREA
004E            ;
0000                    ORG 0100H%256
0000            PGSK    EQU $
```

```
0000                    EJECT
0000            ;
0000            ;       CONFIGURATION FLAG DEFINITIONS
0000            ;
0000            CFCF0   EQU (CFCF+0).0
0000            CFCF1   EQU (CFCF+0).1
0000            CFCF2   EQU (CFCF+0).2
0000            CFCF4   EQU (CFCF+1).0
0000            CFCF5   EQU (CFCF+1).1
0000            CFCF6   EQU (CFCF+1).2
0000            CFCF7   EQU (CFCF+1).3
0000            ;
0000            ;       INTERVAL TIMER FLAG DEFINITIONS
0000            ;
0000            ITCF0   EQU (ITCF+0).0
0000            ITCF1   EQU (ITCF+0).1
0000            ITCF2   EQU (ITCF+0).2
0000            ATE     EQU (ITCF+0).3
0000            SPE     EQU (ITCF+1).0
0000            ;
0000            ;       KEYBOARD FLAG DEFINITIONS
0000            ;
0000            KBCF0   EQU (KBCF+0).0
0000            KBCF1   EQU (KBCF+0).1
0000            KEF     EQU (KBCF+0).3
0000            KBCF4   EQU (KBCF+1).0
0000            PWK     EQU (KBCF+1).1
0000            ;
0000            ;       POWER FLAG DEFINITIONS
0000            ;
0000            MPX     EQU (PWCF+0).2
0000            MPE     EQU (PWCF+0).3
0000            MSE     EQU (PWCF+1).0
0000            LDE     EQU (PWCF+1).1
0000            ;
0000            ;       HEATER FLAG DEFINITIONS
0000            ;
0000            H1C     EQU (HTCF+0).0
0000            H1P     EQU (HTCF+0).1
0000            H1H     EQU (HTCF+0).2
0000            H1E     EQU (HTCF+0).3
0000            H2C     EQU (HTCF+1).0
0000            H2P     EQU (HTCF+1).1
0000            H2H     EQU (HTCF+1).2
0000            H2E     EQU (HTCF+1).3
0000            HTC     EQU (HTCF+2).0
0000            HTP     EQU (HTCF+2).1
0000            HTH     EQU (HTCF+2).2
0000            HTE     EQU (HTCF+2).3
```

BIGMAN WAND CONTROL PROGRAM (BGMNCP) Page 9
Assembly Listing

```
0000                    EJECT
0000            ;
0000            ;       MOTOR FLAG DEFINITIONS
0000            ;
0000            M1R     EQU (MTCF+0).0
0000            M1C     EQU (MTCF+0).1
0000            M1L     EQU (MTCF+0).2
0000            M2R     EQU (MTCF+1).0
0000            M2C     EQU (MTCF+1).1
0000            M2L     EQU (MTCF+1).2
0000            M5B     EQU (MTCF+2).0
0000            M4B     EQU (MTCF+2).1
0000            M3B     EQU (MTCF+2).2
0000            MRE     EQU (MTCF+3).0
0000            MLE     EQU (MTCF+3).1
0000            ;
0000            ;       OPERATING MODE FLAG DEFINITIONS
0000            ;
0000            MNM     EQU (OMCF+0).0
0000            PLM     EQU (OMCF+0).1
0000            WVM     EQU (OMCF+0).2
0000            SEM     EQU (OMCF+0).3
0000            ;
0000            ;       ZONE FLAG DEFINITIONS
0000            ;
0000            Z1E     EQU (ZNCF+0).0
0000            Z2E     EQU (ZNCF+0).1
0000            Z3E     EQU (ZNCF+0).2
0000            Z4E     EQU (ZNCF+0).3
0000            Z5E     EQU (ZNCF+1).0
0000            ;
0000            ;       PULSE FLAG DEFINITIONS
0000            ;
0000            PLCF0   EQU (PLCF+0).0
0000            ;
0000            ;       TEST FLAG DEFINITIONS
0000            ;
0000            TSCF0   EQU (TSCF+0).0
0000            TSCF1   EQU (TSCF+0).1
0000            TSCF3   EQU (TSCF+0).3
0000            TSCF7   EQU (TSCF+1).3
```

```
BIGMAN WAND CONTROL PROGRAM  (BGMNCP)                                  Page 10
Assembly Listing

  355  0000                        EJECT
  356  0000            ;
  357  0000            ;           PROGRAM MEMORY STARTING PAGE
  358  0000            ;
  359  0000                        ORG 00000H
  360  0000            ;
  361  0000            ;           RESET AND INTERRUPT VECTORS
  362  0000            ;
  363  0000 002D                   VENT0 0,0,POIN
  364  0002 002D                   VENT1 0,0,POIN
  365  0004 002D                   VENT2 0,0,POIN
  366  0006 002D                   VENT3 0,0,POIN
  367  0008 002D                   VENT4 0,0,POIN
  368  000A 03A1                   VENT5 0,0,T0IP
  369  000C            ;
  370  000C            ;           COPYRIGHT NOTICE
  371  000C            ;
  372  000C 434F5059               DB 'COPYRIGHT (C) J. B. RESEARCH 1996'
       0010 52494748
       0014 54202843
       0018 29204A2E
       001C 20422E20
       0020 52455345
       0024 41524348
       0028 20313939
       002C 36
```

```
BIGMAN WAND CONTROL PROGRAM  (BGMNCP)                                  Page 11
Assembly Listing

 373  002D                      EJECT
 374  002D            ;
 375  002D            ;         POWER-ON INITIALIZATION ROUTINE
 376  002D            ;
 377  002D FEB2        POIN:    DI
 378  002F B3                   LD A,#03H
 379  0030 89B3                 LD PCONR,A
 380  0032 B0                   LD A,#00H
 381  0033 89F0                 LD P0,A
 382  0035 89F3                 LD P3,A
 383  0037 89F6                 LD P6,A
 384  0039 B8                   LD A,#08H
 385  003A 89F5                 LD P5,A
 386  003C BF                   LD A,#0FH
 387  003D 89E2                 LD P2MDR,A
 388  003F 8177                 LD EA,#077H
 389  0041 CDE8                 LD PMG1R,EA
 390  0043 810F                 LD EA,#00FH
 391  0045 CDEA                 LD PMG2R,EA
 392  0047 81FF                 LD EA,#0FFH
 393  0049 CDEC                 LD PMG3R,EA
 394  004B 8102                 LD EA,#002H
 395  004D CDDC                 LD PUMDR,EA
 396  004F 8168                 LD EA,#068H
 397  0051 CD90                 LD T0MDR,EA
 398  0053 8122                 LD EA,#T0SPT-1
 399  0055 CD96                 LD T0RFR,EA
 400  0057 816C                 LD EA,#06CH
 401  0059 CD90                 LD T0MDR,EA
 402  005B 8100                 LD EA,#0
 403  005D CD0C                 LD ITCB,EA
 404  005F FF9C                 BITS T0IEN
 405  0061 8CF2                 LD A,P2
 406  0063 69                   XCH A,E
 407  0064 8CF1                 LD A,P1
 408  0066 FFF6                 BITS P6.3
 409  0068 8373                 LD HL,#073H
 410  006A DC1A                 AND EA,HL
 411  006C E201                 BTSF EREG.2
 412  006E 15                   JR POINA
 413  006F D301                 BTST EREG.1
 414  0071 C001                 BITR EREG.0
 415  0073 14                   JR POINB
 416  0074 D201        POINA:   BTSF EREG.1
 417  0076 C920                 ADS EA,#020H
 418  0078 A4          POINB:   ADS A,#04H
 419  0079 CD08                 LD CFCF,EA
 420  007B 852A                 LD WX,#(-((30*100)/T0CYT))%256
 421  007D F8F2        POINC:   BTSF P2.3
 422  007F E008                 BITR CFCF2
 423  0081 FD8C                 BTSTZ T0IRQ
 424  0083 09                   JR POINC
 425  0084 84                   INCS WX
 426  0085 07                   JR POINC
 427  0086 830A                 LD HL,#MISA
 428  0088 B0                   LD A,#0
```

BIGMAN WAND CONTROL PROGRAM (BGMNCP) Page 12
Assembly Listing

```
429  0089 C4        POIND:  LD @HL,A
430  008A 82                INCS HL
431  008B 0D                JR POIND
432  008C 819B              LD EA,#(DFINL*255)/100
433  008E CD48              LD INCB,EA
434  0090 8123              LD EA,#DFSPL/T0T0P
435  0092 CD44              LD SPCB,EA
```

```
0094                    EJECT
0094            ;
0094            ;       MASSAGE POWER-OFF RESET ROUTINE
0094            ;
0094 8100       MPRS:   LD EA,#PGSK
0096 CD80               LD SP,EA
0098 EB24               CALLS RSOM
009A EACC               CALLS RSZN
009C 8100               LD EA,#000H
009E CD26               LD HTCF,EA
00A0 B3                 LD A,#03H
00A1 8939               LD MTCF+3,A
00A3 B6                 LD A,#KEL%16
00A4 8941               LD SECB+1,A
00A6 C13A               BITS MNM
00A8 C13C               BITS Z1E
00AA FFB2               EI
00AC            ;
00AC            ;       MASSAGE POWER-OFF IDLE ROUTINE
00AC            ;
00AC 8100       MPID:   LD EA,#PGSK
00AE CD80               LD SP,EA
00B0 EB68               CALLS RSMT
00B2 F30A       MPIDA:  BTST ATE
00B4 EB2B               CALLS RSTM
00B6 D315               BTST PWK
00B8 90D7               JPS MPIDC
00BA D24C               BTSF TSCF1
00BC F30A               BTST ATE
00BE 16                 JR MPIDB
00BF EAFE               CALLS IRPW
00C1 F14C               BITS TSCF3
00C3 91BE               JPS TSMD
00C5 EB00       MPIDB:  CALLS IMPW
00C7 8C40               LD A,SECB
00C9 F23A               BTSF SEM
00CB 9189               JPS SEMD
00CD E23A               BTSF WVM
00CF 9164               JPS WVMD
00D1 D23A               BTSF PLM
00D3 913A               JPS PLMD
00D5 9122               JPS MNMD
00D7 EB49       MPIDC:  CALLS TFKE
00D9 90B2               JPS MPIDA
00DB D941               CPSE E,#KZN
00DD 90E5               JPS MPIDD
00DF EAC9               CALLS INZN
00E1 EAFE               CALLS IRPW
00E3 9122               JPS MNMD
00E5 D931       MPIDD:  CPSE E,#KSE
00E7 90F3               JPS MPIDE
00E9 EACC               CALLS RSZN
00EB C13A               BITS MNM
00ED 29                 PUSH EA
00EE EAFE               CALLS IRPW
00F0 28                 POP EA
```

BIGMAN WAND CONTROL PROGRAM (BGMNCP) Page 14
Assembly Listing

```
492  00F1 9189              JPS SEMD
493  00F3 8351      MPIDE:  LD HL,#KIU
494  00F5 DCEA              CPSE EA,HL
495  00F7 9101              JPS MPIDF
496  00F9 8147              LD EA,#TSMSD/TØCYT
497  00FB EB3E              CALLS SATM
498  00FD C14C              BITS TSCFØ
499  00FF 90B2              JPS MPIDA
500  0101 8352      MPIDF:  LD HL,#KSD
501  0103 DCEA              CPSE EA,HL
502  0105 9114              JPS MPIDG
503  0107 C24C              BTSF TSCFØ
504  0109 F30A              BTST ATE
505  010B 18                JR MPIDG
506  010C 81D6              LD EA,#TSMED/TØCYT
507  010E EB3E              CALLS SATM
508  0110 D14C              BITS TSCF1
509  0112 90B2              JPS MPIDA
510  0114 EB2B      MPIDG:  CALLS RSTM
511  0116 90B2              JPS MPIDA
```

BIGMAN WAND CONTROL PROGRAM (BGMNCP) Page 15
Assembly Listing

```
0118                        EJECT
0118                ;
0118                ;       SELECT ZONE MODE ROUTINE
0118                ;
0118 D910           SLZM:   CPSE A,#KWV%16
011A 12                     JR SLZMA
011B 9164                   JPS WVMD
011D D920           SLZMA:  CPSE A,#KPL%16
011F 12                     JR MNMD
0120 913A                   JPS PLMD
0122                ;
0122                ;       MANUAL MODE ROUTINE
0122                ;
0122 EB57           MNMD:   CALLS IZMT
0124 C13A                   BITS MNM
0126 CE3C           MNMDA:  LD EA,ZNCF
0128 EB78                   CALLS SZMT
012A EB45           MNMDB:  CALLS TFKR
012C 0D                     JR MNMDB
012D EAD3                   CALLS PRZN
012F 06                     JR MNMDA
0130 D921                   CPSE E,#KMD
0132 9189                   JPS SEMD
0134 D900                   CPSE A,#KMN%16
0136 9118                   JPS SLZM
0138 912A                   JPS MNMDB
```

```
538  013A                    EJECT
539  013A            ;
540  013A            ;       PULSE MODE ROUTINE
541  013A            ;
542  013A EB57       PLMD:   CALLS IZMT
543  013C D13A               BITS PLM
544  013E EB0B               CALLS RSSC
545  0140 C142               BITS PLCF0
546  0142 8100       PLMDA:  LD EA,#000H
547  0144 C242               BTSF PLCF0
548  0146 CE3C               LD EA,ZNCF
549  0148 EB78               CALLS SZMT
550  014A EB1E       PLMDB:  CALLS TFSF
551  014C 15                 JR PLMDC
552  014D CA42               INCS PLCF
553  014F A0                 NOP
554  0150 9142               JPS PLMDA
555  0152 EB45       PLMDC:  CALLS TFKR
556  0154 914A               JPS PLMDB
557  0156 EAD3               CALLS PRZN
558  0158 9142               JPS PLMDA
559  015A D921               CPSE E,#KMD
560  015C 9189               JPS SEMD
561  015E D920               CPSE A,#KPL%16
562  0160 9118               JPS SLZM
563  0162 914A               JPS PLMDB
564  0164            ;
565  0164            ;       WAVE MODE ROUTINE
566  0164            ;
567  0164 EB57       WVMD:   CALLS IZMT
568  0166 E13A               BITS WVM
569  0168 EB0B               CALLS RSSC
570  016A EA77               CALLS INZS
571  016C EABA       WVMDA:  CALLS LDZS
572  016E EB78               CALLS SZMT
573  0170 EB1E       WVMDB:  CALLS TFSF
574  0172 14                 JR WVMDC
575  0173 EA80               CALLS AVZS
576  0175 916C               JPS WVMDA
577  0177 EB45       WVMDC:  CALLS TFKR
578  0179 9170               JPS WVMDB
579  017B EAD3               CALLS PRZN
580  017D 916C               JPS WVMDA
581  017F D921               CPSE E,#KMD
582  0181 9189               JPS SEMD
583  0183 D910               CPSE A,#KWV%16
584  0185 9118               JPS SLZM
585  0187 9170               JPS WVMDB
```

```
BIGMAN WAND CONTROL PROGRAM  (BGMNCP)                                  Page 17
Assembly Listing

  586  0189                        EJECT
  587  0189              ;
  588  0189              ;         SPECIAL EFFECTS MODE ROUTINE
  589  0189              ;
  590  0189 EB51         SEMD:     CALLS IEMT
  591  018B F13A                   BITS SEM
  592  018D 8940         SEMDA:    LD SECB,A
  593  018F EB0B         SEMDB:    CALLS RSSC
  594  0191 C042                   BITR PLCF0
  595  0193 8C42         SEMDC:    LD A,PLCF
  596  0195 88                     RRC A
  597  0196 EAF0                   CALLS LDSE
  598  0198 EB6D                   CALLS SEMT
  599  019A EB1E         SEMDD:    CALLS TFSF
  600  019C 15                     JR SEMDE
  601  019D CA42                   INCS PLCF
  602  019F A0                     NOP
  603  01A0 9193                   JPS SEMDC
  604  01A2 EB45         SEMDE:    CALLS TFKR
  605  01A4 919A                   JPS SEMDD
  606  01A6 D941                   CPSE E,#KZN
  607  01A8 16                     JR SEMDF
  608  01A9 EAC9                   CALLS INZN
  609  01AB EB24                   CALLS RSOM
  610  01AD 9122                   JPS MNMD
  611  01AF D931         SEMDF:    CPSE E,#KSE
  612  01B1 9118                   JPS SLZM
  613  01B3 8340                   LD HL,#SECB
  614  01B5 38                     CPSE A,@HL
  615  01B6 918D                   JPS SEMDA
  616  01B8 EAE5                   CALLS AVSE
  617  01BA 919A                   JPS SEMDD
  618  01BC 918F                   JPS SEMDB
```

```
BIGMAN WAND CONTROL PROGRAM  (BGMNCP)                                  Page 18
Assembly Listing

  619  01BE                      EJECT
  620  01BE              ;
  621  01BE              ;        TEST MODE ROUTINE
  622  01BE              ;
  623  01BE EB57          TSMD:   CALLS IZMT
  624  01C0 EACC                  CALLS RSZN
  625  01C2 EB0B                  CALLS RSSC
  626  01C4 8100                  LD EA,#000H
  627  01C6 CD26                  LD HTCF,EA
  628  01C8 B3                    LD A,#03H
  629  01C9 8939                  LD MTCF+3,A
  630  01CB EB16                  CALLS WFSF
  631  01CD E120                  BITS MPX
  632  01CF EB16                  CALLS WFSF
  633  01D1 C308                  BTST CFCF0
  634  01D3 B9                    LD A,#09H
  635  01D4 BD                    LD A,#0DH
  636  01D5 8926                  LD HTCF,A
  637  01D7 EB16                  CALLS WFSF
  638  01D9 C308                  BTST CFCF0
  639  01DB 16                    JR TSMDA
  640  01DC 81D0                  LD EA,#0D0H
  641  01DE CD26                  LD HTCF,EA
  642  01E0 EB16                  CALLS WFSF
  643  01E2 BD           TSMDA:   LD A,#0DH
  644  01E3 8926                  LD HTCF,A
  645  01E5 EB16                  CALLS WFSF
  646  01E7 C13A                  BITS MNM
  647  01E9 EB16                  CALLS WFSF
  648  01EB D90C                  LD X,#0
  649  01ED DD0C         TSMDB:   LD A,X
  650  01EF EAD6                  CALLS TGZN
  651  01F1 EB78                  CALLS SZMT
  652  01F3 EB16                  CALLS WFSF
  653  01F5 5C                    INCS X
  654  01F6 D954                  CPSE X,#5
  655  01F8 04                    JR TSMDB
  656  01F9 C03A                  BITR MNM
  657  01FB D13A                  BITS PLM
  658  01FD 85FB                  LD WX,#-5
  659  01FF 8100         TSMDC:   LD EA,#0
  660  0201 C304                  BTST XREG.0
  661  0203 CE3C                  LD EA,ZNCF
  662  0205 EB78                  CALLS SZMT
  663  0207 EB16                  CALLS WFSF
  664  0209 84                    INCS WX
  665  020A 04                    JR TSMDC
  666  020B D03A                  BITR PLM
  667  020D E13A                  BITS WVM
  668  020F 85F7                  LD WX,#-9
  669  0211 F209                  BTSF CFCF7
  670  0213 85F6                  LD WX,#-10
  671  0215 EA77                  CALLS INZS
  672  0217 EABA         TSMDD:   CALLS LDZS
  673  0219 EB78                  CALLS SZMT
  674  021B EB16                  CALLS WFSF
```

BIGMAN WAND CONTROL PROGRAM (BGMNCP) Page 19
Assembly Listing

```
675  021D EA80              CALLS AVZS
676  021F 84                INCS WX
677  0220 06                JR TSMDD
678  0221 E03A              BITR WVM
679  0223 D209              BTSF CFCF5
680  0225 925A              JPS TSMDH
681  0227 8160              LD EA,#((KEL%16)*16)+0
682  0229 CD40              LD SECB,EA
683  022B 87A0              LD YZ,#((-(KEL%16))*16)+0
684  022D E209              BTSF CFCF6
685  022F 8780              LD YZ,#((-((KEL%16)+2))*16)+0
686  0231 C309              BTST CFCF4
687  0233 16                JR TSMDE
688  0234 E309              BTST CFCF6
689  0236 9267              JPS TSMDJ
690  0238 87E6              LD YZ,#((-2)*16)+(KEL%16)
691  023A F13A      TSMDE:  BITS SEM
692  023C EB51              CALLS IEMT
693  023E D96D              LD W,#KEL%16
694  0240 DD0E      TSMDF:  LD A,Z
695  0242 8940              LD SECB,A
696  0244 D9CC              LD X,#-4
697  0246 DD0C      TSMDG:  LD A,X
698  0248 88                RRC A
699  0249 EAF0              CALLS LDSE
700  024B EB6D              CALLS SEMT
701  024D EB16              CALLS WFSF
702  024F 5C                INCS X
703  0250 05                JR TSMDG
704  0251 DD0E              LD A,Z
705  0253 EAE5              CALLS AVSE
706  0255 5E                INCS Z
707  0256 5F                INCS Y
708  0257 9240              JPS TSMDF
709  0259 1D                JR TSMDJ
710  025A C13A      TSMDH:  BITS MNM
711  025C CE3C              LD EA,ZNCF
712  025E EB78              CALLS SZMT
713  0260 EE5A      TSMDI:  CALLS AVLR
714  0262 EB16              CALLS WFSF
715  0264 D239              BTSF MLE
716  0266 09                JR TSMDI
717  0267 EB68      TSMDJ:  CALLS RSMT
718  0269 EB24              CALLS RSOM
719  026B EB16              CALLS WFSF
720  026D 8100              LD EA,#000H
721  026F CD26              LD HTCF,EA
722  0271 EB16              CALLS WFSF
723  0273 F020              BITR MPE
724  0275 9094              JPS MPRS
```

```
BIGMAN WAND CONTROL PROGRAM  (BGMNCP)                                  Page 2(
Assembly Listing

 725  0277                      EJECT
 726  0277              ;
 727  0277              ;        INITIALIZE ZONE SELECT SUBROUTINE
 728  0277              ;
 729  0277 8100         INZS:    LD EA,#000H
 730  0279 CD3E                  LD ZSCB,EA
 731  027B EABA                  CALLS LDZS
 732  027D DCD8                  DECS EA
 733  027F C5                    RET
 734  0280              ;
 735  0280              ;        ADVANCE ZONE SELECT SUBROUTINE
 736  0280              ;
 737  0280 2F           AVZS:    PUSH YZ
 738  0281 878F                  LD YZ,#(((-8)%16)*16)+((-1)%16)
 739  0283 EABA                  CALLS LDZS
 740  0285 C9FF                  ADS EA,#-1
 741  0287 14                    JR AVZSA
 742  0288 8C3E                  LD A,ZSCB
 743  028A DD06                  LD Z,A
 744  028C CE3E         AVZSA:   LD EA,ZSCB
 745  028E D901                  CPSE E,#0
 746  0290 1B                    JR AVZSB
 747  0291 58                    INCS A
 748  0292 D950                  CPSE A,#5
 749  0294 1B                    JR AVZSC
 750  0295 F209                  BTSF CFCF7
 751  0297 8100                  LD EA,#000H+0
 752  0299 8113                  LD EA,#010H+3
 753  029B 14                    JR AVZSC
 754  029C 48           AVZSB:   DECS A
 755  029D 12                    JR AVZSC
 756  029E 8101                  LD EA,#000H+1
 757  02A0 CD3E         AVZSC:   LD ZSCB,EA
 758  02A2 EABA                  CALLS LDZS
 759  02A4 C9FF                  ADS EA,#-1
 760  02A6 15                    JR AVZSD
 761  02A7 8C3E                  LD A,ZSCB
 762  02A9 DD6E                  CPSE A,Z
 763  02AB 1C                    JR AVZSF
 764  02AC 5F           AVZSD:   INCS Y
 765  02AD 928C                  JPS A,ZSA
 766  02AF DD0E                  LD A,Z
 767  02B1 5E                    INCS Z
 768  02B2 11                    JR AVZSE
 769  02B3 B0                    LD A,#0
 770  02B4 D909         AVZSE:   LD E,#00H
 771  02B6 CD3E                  LD ZSCB,EA
 772  02B8 2E           AVZSF:   POP YZ
 773  02B9 C5                    RET
```

```
BIGMAN WAND CONTROL PROGRAM  (BGMNCP)                                  Page 21
Assembly Listing

 774  02BA                      EJECT
 775  02BA              ;
 776  02BA              ;        LOAD ZONE SELECT SUBROUTINE
 777  02BA              ;
 778  02BA 8C3E         LDZS:    LD A,ZSCB
 779  02BC D909                  LD E,#0
 780  02BE C98C                  ADS EA,#ZNST%256
 781  02C0 EF88                  CALLS LIEA
 782  02C2 DCF2                  LD HL,EA
 783  02C4 CE3C                  LD EA,ZNCF
 784  02C6 DC1A                  AND EA,HL
 785  02C8 C5                    RET
 786  02C9              ;
 787  02C9              ;        INITIALIZE ZONE SUBROUTINE
 788  02C9              ;
 789  02C9 EACC         INZN:    CALLS RSZN
 790  02CB 1A                    JR TGZN
 791  02CC              ;
 792  02CC              ;        RESET ZONES SUBROUTINE
 793  02CC              ;
 794  02CC 29           RSZN:    PUSH EA
 795  02CD 8100                  LD EA,#0
 796  02CF CD3C                  LD ZNCF,EA
 797  02D1 28                    POP EA
 798  02D2 C5                    RET
 799  02D3              ;
 800  02D3              ;        PROCESS ZONE SUBROUTINE
 801  02D3              ;
 802  02D3 D941         PRZN:    CPSE E,#KZN
 803  02D5 E5                    SRET
 804  02D6              ;
 805  02D6              ;        TOGGLE ZONE SUBROUTINE
 806  02D6              ;
 807  02D6 D909         TGZN:    LD E,#0
 808  02D8 C98C                  ADS EA,#ZNST%256
 809  02DA EF88                  CALLS LIEA
 810  02DC DCF2                  LD HL,EA
 811  02DE CE3C                  LD EA,ZNCF
 812  02E0 DC3A                  XOR EA,HL
 813  02E2 CD3C                  LD ZNCF,EA
 814  02E4 C5                    RET
```

```
BIGMAN WAND CONTROL PROGRAM  (BGMNCP)                                    Page 22
Assembly Listing

 815  02E5                      EJECT
 816  02E5            ;
 817  02E5            ;         ADVANCE SPECIAL EFFECT SUBROUTINE
 818  02E5            ;
 819  02E5 D960       AVSE:     CPSE A,#KEL%16
 820  02E7 C5                   RET
 821  02E8 8C41                 LD A,SECB+1
 822  02EA A9                   ADS A,#-((KEL%16)+1)
 823  02EB A8                   ADS A,#(KEL%16)+2
 824  02EC B6                   LD A,#KEL%16
 825  02ED 8941                 LD SECB+1,A
 826  02EF E5                   SRET
 827  02F0            ;
 828  02F0            ;         LOAD SPECIAL EFFECT SUBROUTINE
 829  02F0            ;
 830  02F0 8C40       LDSE:     LD A,SECB
 831  02F2 AA                   ADS A,#-(KEL%16)
 832  02F3 A6                   ADS A,#KEL%16
 833  02F4 8C41                 LD A,SECB+1
 834  02F6 D909                 LD E,#0
 835  02F8 DCA8                 ADC EA,EA
 836  02FA C991                 ADS EA,#SEST%256
 837  02FC 9788                 JPS LIEA
 838  02FE            ;
 839  02FE            ;         INITIALIZE MASSAGE POWER SUBROUTINES
 840  02FE            ;
 841  02FE EB24       IRPW:     CALLS RSOM
 842  0300 EB2B       IMPW:     CALLS RSTM
 843  0302 CD22                 LD PWCB,EA
 844  0304 CD24                 LD PWCB+2,EA
 845  0306 E020                 BITR MPX
 846  0308 F120                 BITS MPE
 847  030A C5                   RET
```

```
BIGMAN WAND CONTROL PROGRAM  (BGMNCP)                                  Page 23
Assembly Listing

 848  030B                        EJECT
 849  030B              ;
 850  030B              ;         RESET SPEED COUNTER SUBROUTINE
 851  030B              ;
 852  030B FEB2          RSSC:     DI
 853  030D 8100                    LD EA,#0
 854  030F CD46                    LD SPCB+2,EA
 855  0311 C00B                    BITR SPE
 856  0313 FFB2                    EI
 857  0315 C5                      RET
 858  0316              ;
 859  0316              ;         WAIT FOR SPEED COUNTER FLAG SUBROUTINE
 860  0316              ;
 861  0316 F320         WFSF:     BTST MPE
 862  0318 9094                    JPS MPRS
 863  031A EB1E                    CALLS TFSF
 864  031C 09                      JR WFSF
 865  031D C5                      RET
 866  031E              ;
 867  031E              ;         TEST FOR SPEED COUNTER FLAG SUBROUTINE
 868  031E              ;
 869  031E C30B         TFSF:     BTST SPE
 870  0320 C5                      RET
 871  0321 C00B                    BITR SPE
 872  0323 E5                      SRET
 873  0324              ;
 874  0324              ;         RESET OPERATING MODE SUBROUTINE
 875  0324              ;
 876  0324 29           RSOM:     PUSH EA
 877  0325 8100                    LD EA,#0
 878  0327 CD3A                    LD OMCF,EA
 879  0329 28                      POP EA
 880  032A C5                      RET
 881  032B              ;
 882  032B              ;         RESET TEST MODE SUBROUTINE
 883  032B              ;
 884  032B 8100         RSTM:     LD EA,#0
 885  032D CD4C                    LD TSCF,EA
 886  032F F00A                    BITR ATE
 887  0331 C5                      RET
```

BIGMAN WAND CONTROL PROGRAM (BGMNCP) Page 24
Assembly Listing

```
0332                    EJECT
0332            ;
0332            ;       COMPUTE SPEED ADJUSTMENT SUBROUTINE
0332            ;
0332 CE44       CPSA:   LD EA,SPCB
0334 DCF2               LD HL,EA
0336 B0                 LD A,#0
0337 69                 XCH A,E
0338 AF                 ADS A,#-1
0339 B0                 LD A,#0
033A 5B                 INCS A
033B DCE2               XCH EA,HL
033D C5                 RET
033E            ;
033E            ;       SET AUXILIARY TIMER SUBROUTINE
033E            ;
033E F00A       SATM:   BITR ATE
0340 CD12               LD ITCB+6,EA
0342 F10A               BITS ATE
0344 C5                 RET
0345            ;
0345            ;       TEST FOR KEY ENTRY SUBROUTINES
0345            ;
0345 F320       TFKR:   BTST MPE
0347 90AC               JPS MPID
0349 F314       TFKE:   BTST KEF
034B C5                 RET
034C CE1C               LD EA,KBDB
034E F014               BITR KEF
0350 E5                 SRET
0351            ;
0351            ;       INITIALIZE MOTORS SUBROUTINES
0351            ;
0351 EB24       IEMT:   CALLS RSOM
0353 C221               BTSF MSE
0355 C5                 RET
0356 15                 JR IZMTA
0357 EB24       IZMT:   CALLS RSOM
0359 C321               BTST MSE
035B C5                 RET
035C 29         IZMTA:  PUSH EA
035D EB6B               CALLS RSMT
035F 8109               LD EA,#MCTOD/T0CYT
0361 EB3E               CALLS SATM
0363 F20A       IZMTB:  BTSF ATE
0365 0D                 JR IZMTB
0366 28                 POP EA
0367 C5                 RET
```

BIGMAN WAND CONTROL PROGRAM (BGMNCP) Page 25
Assembly Listing

```
936  0368                    EJECT
937  0368          ;
938  0368          ;         RESET MOTORS SUBROUTINE
939  0368          ;
940  0368 8100     RSMT:     LD EA,#0
941  036A C321               BTST MSE
942  036C 1B                 JR SZMT
943  036D          ;
944  036D          ;         SET SPECIAL EFFECTS MOTORS SUBROUTINE
945  036D          ;
946  036D FEB2     SEMT:     DI
947  036F C121               BITS MSE
948  0371 DCF2               LD HL,EA
949  0373 CD36               LD MTCF,EA
950  0375 B0                 LD A,#0
951  0376 9396               JPS SZMTA
952  0378          ;
953  0378          ;         SET ZONE MOTORS SUBROUTINE
954  0378          ;
955  0378 DCF2     SZMT:     LD HL,EA
956  037A 8100               LD EA,#000H
957  037C C202               BTSF LREG.0
958  037E B5                 LD A,#05H
959  037F D202               BTSF LREG.1
960  0381 D959               LD E,#05H
961  0383 FEB2               DI
962  0385 C021               BITR MSE
963  0387 CD36               LD MTCF,EA
964  0389 B0                 LD A,#0
965  038A E202               BTSF LREG.2
966  038C E100               BITS AREG.2
967  038E F202               BTSF LREG.3
968  0390 D100               BITS AREG.1
969  0392 C203               BTSF HREG.0
970  0394 C100               BITS AREG.0
971  0396 B938     SZMTA:    LD MTCF+2,A
972  0398 D021               BITR LDE
973  039A DCDA               DECS HL
974  039C D121               BITS LDE
975  039E FFB2               EI
976  03A0 C5                 RET
```

```
BIGMAN WAND CONTROL PROGRAM  (BGMNCP)                                    Page 26
Assembly Listing

 977  03A1                      EJECT
 978  03A1            ;
 979  03A1            ;         TIMER 0 INTERRUPT PROCESSING SUBROUTINE
 980  03A1            ;
 981  03A1 29         T0IP:     PUSH EA
 982  03A2 2B                   PUSH HL
 983  03A3 2D                   PUSH WX
 984  03A4 2F                   PUSH YZ
 985  03A5 CE0C                 LD EA,ITCB
 986  03A7 8300                 LD HL,#0
 987  03A9 DCEA                 CPSE EA,HL
 988  03AB 941A                 JPS T0I1
 989  03AD            ;
 990  03AD            ;         TIMER 0 INTERRUPT PROCESSING PART 0
 991  03AD            ;
 992  03AD 8107       T0I0:     LD EA,#T0IUL
 993  03AF CD0C                 LD ITCB,EA
 994  03B1 81F4                 LD EA,#(T0SPT*T0IUL)-1
 995  03B3 CD96                 LD T0RFR,EA
 996  03B5 EF4A                 CALLS RSMI
 997  03B7 D226                 BTSF H1P
 998  03B9 FFC5                 BITS P5.0
 999  03BB D326                 BTST H1P
1000  03BD FEC5                 BITR P5.0
1001  03BF D227                 BTSF H2P
1002  03C1 FFD5                 BITS P5.1
1003  03C3 D327                 BTST H2P
1004  03C5 FED5                 BITR P5.1
1005  03C7 C221                 BTSF MSE
1006  03C9 17                   JR T0I0A
1007  03CA FEE5                 BITR P5.2
1008  03CC EF10                 CALLS EAMT
1009  03CE FFD6                 BITS P6.1
1010  03D0 16                   JR T0I0B
1011  03D1 FFE5       T0I0A:    BITS P5.2
1012  03D3 EF10                 CALLS EAMT
1013  03D5 FFC0                 BITS P0.0
1014  03D7 EC9C       T0I0B:    CALLS KBSC
1015  03D9 F220                 BTSF MPE
1016  03DB 1A                   JR T0I0C
1017  03DC D24C                 BTSF TSCF1
1018  03DE F30A                 BTST ATE
1019  03E0 19                   JR T0I0D
1020  03E1 F24D                 BTSF TSCF7
1021  03E3 FEC4                 BITR P4.0
1022  03E5 14                   JR T0I0D
1023  03E6 E220       T0I0C:    BTSF MPX
1024  03E8 FEC4                 BITR P4.0
1025  03EA F220       T0I0D:    BTSF MPE
1026  03EC F23A                 BTSF SEM
1027  03EE 14                   JR T0I0E
1028  03EF C23A                 BTSF MNM
1029  03F1 FEE4                 BITR P4.2
1030  03F3 C208       T0I0E:    BTSF CFCF0
1031  03F5 19                   JR T0I0F
1032  03F6 F326                 BTST H1E
```

```
BIGMAN WAND CONTROL PROGRAM  (BGMNCP)                                  Page 27
Assembly Listing

 1033  03F8 9408              JPS TØIØG
 1034  03FA E326              BTST H1H
 1035  03FC FEF4              BITR P4.3
 1036  03FE 19                JR TØIØG
 1037  03FF F327       TØIØF: BTST H2E
 1038  0401 16                JR TØIØG
 1039  0402 E327              BTST H2H
 1040  0404 D20A              BTSF ITCF1
 1041  0406 FEF4              BITR P4.3
 1042  0408 FEF5       TØIØG: BITR P5.3
 1043  040A ED5A              CALLS UDTM
 1044  040C ED9C              CALLS UDPW
 1045  040E F220              BTSF MPE
 1046  0410 EE17              CALLS UDRT
 1047  0412 D209              BTSF CFCF5
 1048  0414 EE53              CALLS UDLR
 1049  0416 EEA7              CALLS UDIC
 1050  0418 9497              JPS TØIR
```

```
BIGMAN WAND CONTROL PROGRAM  (BGMNCP)                                  Page 28
Assembly Listing

 1051  041A                      EJECT
 1052  041A              ;
 1053  041A              ;        TIMER Ø INTERRUPT PROCESSING PART 1
 1054  041A              ;
 1055  041A C9Ø1         TØI1:    ADS EA,#1
 1056  041C CFØC                  XCH EA,ITCB
 1057  041E DCF2                  LD HL,EA
 1058  0420 DCF4                  LD WX,EA
 1059  0422 8122                  LD EA,#TØSPT-1
 1060  0424 CD96                  LD TØRFR,EA
 1061  0426 CE4A                  LD EA,INCB+2
 1062  0428 DCB4                  SBS WX,EA
 1063  042A EF36                  CALLS DAMT
 1064  042C 8110                  LD EA,#MIDEP
 1065  042E DCEA                  CPSE EA,HL
 1066  0430 18                    JR TØI1A
 1067  0431 F8E5                  BTSF P5.2
 1068  0433 FEC0                  BITR P0.0
 1069  0435 F9E5                  BTST P5.2
 1070  0437 FED6                  BITR P6.1
 1071  0439 8133         TØI1A:   LD EA,#SIDSP
 1072  043B DCEA                  CPSE EA,HL
 1073  043D 9479                  JPS TØI1G
 1074  043F EF4A                  CALLS RSMI
 1075  0441 F220                  BTSF MPE
 1076  0443 1D                    JR TØI1B
 1077  0444 D24C                  BTSF TSCF1
 1078  0446 F30A                  BTST ATE
 1079  0448 1C                    JR TØI1C
 1080  0449 F34D                  BTST TSCF7
 1081  044B FEC4                  BITR P4.0
 1082  044D CA4D                  INCS TSCF+1
 1083  044F A0                    NOP
 1084  0450 14                    JR TØI1C
 1085  0451 E320         TØI1B:   BTST MPX
 1086  0453 FEC4                  BITR P4.0
 1087  0455 F220         TØI1C:   BTSF MPE
 1088  0457 F23A                  BTSF SEM
 1089  0459 18                    JR TØI1D
 1090  045A D23A                  BTSF PLM
 1091  045C FED4                  BITR P4.1
 1092  045E E23A                  BTSF WVM
 1093  0460 FEE4                  BITR P4.2
 1094  0462 C208         TØI1D:   BTSF CFCFØ
 1095  0464 19                    JR TØI1E
 1096  0465 F326                  BTST H1E
 1097  0467 9477                  JPS TØI1F
 1098  0469 E226                  BTSF H1H
 1099  046B FEF4                  BITR P4.3
 1100  046D 19                    JR TØI1F
 1101  046E F326         TØI1E:   BTST H1E
 1102  0470 16                    JR TØI1F
 1103  0471 E326                  BTST H1H
 1104  0473 D20A                  BTSF ITCF1
 1105  0475 FEF4                  BITR P4.3
 1106  0477 FEF6         TØI1F:   BITR P6.3
```

BIGMAN WAND CONTROL PROGRAM (BGMNCP) Page 29
Assembly Listing

```
1107  0479 813C      TØI1G:  LD EA,#HTCYP
1108  047B DCEA              CPSE EA,HL
1109  047D 1E                JR TØI1I
1110  047E E326              BTST H1H
1111  0480 C326              BTST H1C
1112  0482 12                JR TØI1H
1113  0483 FEC5              BITR P5.0
1114  0485 E327      TØI1H:  BTST H2H
1115  0487 C327              BTST H2C
1116  0489 12                JR TØI1I
1117  048A FED5              BITR P5.1
1118  048C 8163      TØI1I:  LD EA,#99
1119  048E DCEA              CPSE EA,HL
1120  0490 16                JR TØIR
1121  0491 8100              LD EA,#0
1122  0493 CD0C              LD ITCB,EA
1123  0495 EF36              CALLS DAMT
1124  0497           ;
1125  0497           ;       TIMER 0 INTERRUPT RETURN
1126  0497           ;
1127  0497 2E        TØIR:   POP YZ
1128  0498 2C                POP WX
1129  0499 2A                POP HL
1130  049A 28                POP EA
1131  049B D5                IRET
```

BIGMAN WAND CONTROL PROGRAM (BGMNCP) Page 30
Assembly Listing

```
049C                    EJECT
049C            ;
049C            ;       KEYBOARD SCAN SUBROUTINE
049C            ;
049C 85A1       KBSC:   LD WX,#KBCT%256
049E 87FE               LD YZ,#0FEH
04A0 C014               BITR KBCF0
04A2 E7         KBSCA:  SCF
04A3 DCFE               LD EA,YZ
04A5 89F4               LD P4,A
04A7 C307               BTST YREG.0
04A9 FEF5               BITR P5.3
04AB DCA6               ADC YZ,EA
04AD 8CF2               LD A,P2
04AF 69                 XCH A,E
04B0 8CF1               LD A,P1
04B2 DCF2               LD HL,EA
04B4 BF                 LD A,#0FH
04B5 89F4               LD P4,A
04B7 FFF5               BITS P5.3
04B9 818C               LD EA,#08CH
04BB DC2A               OR EA,HL
04BD C940               ADS EA,#040H
04BF 1E                 JR KBSCB-4
04C0 C9E0               ADS EA,#0E0H
04C2 1C                 JR KBSCB-3
04C3 C9F0               ADS EA,#0F0H
04C5 1A                 JR KBSCB-2
04C6 C9F2               ADS EA,#0F2H
04C8 18                 JR KBSCB-1
04C9 C9FF               ADS EA,#0FFH
04CB 16                 JR KBSCB
04CC 94DE               JPS KBSCC
04CE 84                 INCS WX
04CF 84                 INCS WX
04D0 84                 INCS WX
04D1 84                 INCS WX
04D2 C314       KBSCB:  BTST KBCF0
04D4 C901               ADS EA,#1
04D6 954B               JPS KBSCH
04D8 EFBA               CALLS LIWX
04DA CD1E               LD KBDB+2,EA
04DC C114               BITS KBCF0
04DE 8105       KBSCC:  LD EA,#5
04E0 DC94               ADS WX,EA
04E2 D207               BTSF YREG.1
04E4 94A2               JPS KBSCA
04E6 C214               BTSF KBCF0
04E8 9503               JPS KBSCE
04EA CE16               LD EA,KBCB
04EC DCD8               DECS EA
04EE CD16               LD KBCB,EA
04F0 C9FF               ADS EA,#-1
04F2 D315               BTST PWK
04F4 C5                 RET
04F5 D015               BITR PWK
```

BIGMAN WAND CONTROL PROGRAM (BGMNCP) Page 31
Assembly Listing

```
1188  04F7 C215              BTSF KBCF4
1189  04F9 13                JR KBSCD
1190  04FA C115              BITS KBCF4
1191  04FC C5                RET
1192  04FD D214       KBSCD: BTSF KBCF1
1193  04FF C5                RET
1194  0500 F020              BITR MPE
1195  0502 C5                RET
1196  0503 8105       KBSCE: LD EA,#KBDBD/TØCYT
1197  0505 CF16              XCH EA,KBCB
1198  0507 C9FF              ADS EA,#-1
1199  0509 9532              JPS KBSCG
1200  050B CE1C              LD EA,KBDB
1201  050D DCF2              LD HL,EA
1202  050F CE1E              LD EA,KBDB+2
1203  0511 DCEA              CPSE EA,HL
1204  0513 954B              JPS KBSCH
1205  0515 8318              LD HL,#KBCB+2
1206  0517 D951              CPSE E,#KRT
1207  0519 17                JR KBSCF
1208  051A 85F9              LD WX,#-(KBKRD/TØCYT)
1209  051C EF70              CALLS ICTM
1210  051E 12                JR KBSCF
1211  051F F114              BITS KEF
1212  0521 8572       KBSCF: LD WX,#(-(KBKPD/TØCYT))%256
1213  0523 EF6E              CALLS AITM
1214  0525 C5                RET
1215  0526 D114              BITS KBCF1
1216  0528 F34C              BTST TSCF3
1217  052A D315              BTST PWK
1218  052C C5                RET
1219  052D F220              BTSF MPE
1220  052F E120              BITS MPX
1221  0531 C5                RET
1222  0532 F114       KBSCG: BITS KEF
1223  0534 8100              LD EA,#0
1224  0536 CD18              LD KBCB+2,EA
1225  053B CDIA              LD KBCB+4,EA
1226  053A CE1E              LD EA,KBDB+2
1227  053C 8310              LD HL,#KPW
1228  053E DCEA              CPSE EA,HL
1229  0540 9555              JPS KBSCI
1230  0542 F014              BITR KEF
1231  0544 D115              BITS PWK
1232  0546 F320              BTST MPE
1233  0548 C015              BITR KBCF4
1234  054A 1A                JR KBSCI
1235  054B F014       KBSCH: BITR KEF
1236  054D D015              BITR PWK
1237  054F 8105              LD EA,#KBDBD/TØCYT
1238  0551 CD16              LD KBCB,EA
1239  0553 8100              LD EA,#0
1240  0555 CD1C       KBSCI: LD KBDB,EA
1241  0557 D014              BITR KBCF1
1242  0559 C5                RET
```

BIGMAN WAND CONTROL PROGRAM (BGMNCP) Page 32
Assembly Listing

```
055A                    EJECT
055A            ;
055A            ;       UPDATE TIMERS SUBROUTINE
055A            ;
055A C20A       UDTM:   BTSF ITCFØ
055C 14                 JR UDTMA
055D C10A               BITS ITCFØ
055F 9571               JPS UDTMB
0561 C00A       UDTMA:  BITR ITCFØ
0563 8346               LD HL,#SPCB+2
0565 CE44               LD EA,SPCB
0567 8500               LD WX,#Ø
0569 DCB4               SBS WX,EA
056B AØ                 NOP
056C EF70               CALLS ICTM
056E 12                 JR UDTMB
056F C10B               BITS SPE
0571 830E       UDTMB:  LD HL,#ITCB+2
0573 85F9               LD WX,#-(HTFDD/TØCYT)
0575 D20A               BTSF ITCF1
0577 8506               LD WX,#(-(HTFED/TØCYT))%256
0579 EF70               CALLS ICTM
057B 19                 JR UDTMC
057C E6                 RCF
057D D20A               BTSF ITCF1
057F E7                 SCF
0580 D00A               BITR ITCF1
0582 D7                 BTST C
0583 D10A               BITS ITCF1
0585 E00A       UDTMC:  BITR ITCF2
0587 8572               LD WX,#(-((TØT2P*1000)/TØCYT))%256
0589 EF6E               CALLS AITM
058B 12                 JR UDTMD
058C E10A               BITS ITCF2
058E F30A       UDTMD:  BTST ATE
0590 C5                 RET
0591 CE12               LD EA,ITCB+6
0593 DCD8               DECS EA
0595 CD12               LD ITCB+6,EA
0597 C9FF               ADS EA,#-1
0599 F00A               BITR ATE
059B C5                 RET
```

BIGMAN WAND CONTROL PROGRAM (BGMNCP) Page 33
Assembly Listing

```
059C                    EJECT
059C            ;
059C            ;       UPDATE POWER SUBROUTINE
059C            ;
059C F34C       UDPW:   BTST TSCF3
059E E30A               BTST ITCF2
05A0 95C8               JPS UDPWB
05A2 F320               BTST MPE
05A4 95B8               JPS UDPWA
05A6 8322               LD HL,#PWCB
05A8 85E2               LD WX,#-(60/TØT2P)
05AA EF70               CALLS ICTM
05AC 1B                 JR UDPWA
05AD 85F1               LD WX,#-PWOT1
05AF E220               BTSF MPX
05B1 85E2               LD WX,#-PWOT2
05B3 EF6E               CALLS AITM
05B5 12                 JR UDPWA
05B6 F020               BITR MPE
05B8 832A       UDPWA:  LD HL,#H1CB
05BA 8C26               LD A,HTCF
05BC EE7C               CALLS UDHS
05BE 8926               LD HTCF,A
05C0 8330               LD HL,#H2CB
05C2 8C27               LD A,HTCF+1
05C4 EE7C               CALLS UDHS
05C6 8927               LD HTCF+1,A
05C8 D91B       UDPWB:  LD H,#KCT
05CA EF7C               CALLS TFKG
05CC C5                 RET
05CD F24C               BTSF TSCF3
05CF C5                 RET
05D0 E6                 RCF
05D1 D920               CPSE A,#KHL%16
05D3 95E1               JPS UDPWC
05D5 C208               BTSF CFCF0
05D7 9602               JPS UDPWG
05D9 F226               BTSF H1E
05DB E226               BTSF H1H
05DD 95F9               JPS UDPWF
05DF 95ED               JPS UDPWD
05E1 D930       UDPWC:  CPSE A,#KHH%16
05E3 C5                 RET
05E4 C208               BTSF CFCF0
05E6 1B                 JR UDPWE
05E7 E7                 SCF
05E8 F226               BTSF H1E
05EA E326               BTST H1H
05EC 1C                 JR UDPWF
05ED D026       UDPWD:  BITR H1P
05EF F026               BITR H1E
05F1 C5                 RET
05F2 F326       UDPWE:  BTST H1E
05F4 14                 JR UDPWF
05F5 E226               BTSF H1H
05F7 05                 JR UDPWD
```

BIGMAN WAND CONTROL PROGRAM (BGMNCP) Page 34
Assembly Listing

```
05F8 E7                 SCF
05F9 832A      UDPWF:   LD HL,#H1CB
05FB 8C26               LD A,HTCF
05FD EE62               CALLS INHS
05FF 8926               LD HTCF,A
0601 C5                 RET
0602 F327      UDPWG:   BTST H2E
0604 14                 JR UDPWH
0605 E227               BTSF H2H
0607 1A                 JR UDPWI
0608 E7                 SCF
0609 8330      UDPWH:   LD HL,#H2CB
060B 8C27               LD A,HTCF+1
060D EE62               CALLS INHS
060F 8927               LD HTCF+1,A
0611 C5                 RET
0612 D027      UDPWI:   BITR H2P
0614 F027               BITR H2E
0616 C5                 RET
```

BIGMAN WAND CONTROL PROGRAM (BGMNCP) Page 35
Assembly Listing

```
0617                    EJECT
0617            ;
0617            ;       UPDATE RATES SUBROUTINE
0617            ;
0617 D95B       UDRT:   LD H,#KRT
0619 EF7C               CALLS TFKG
061B C5                 RET
061C D900               CPSE A,#KID%16
061E 19                 JR UDRTA
061F CE48               LD EA,INCB
0621 C9BC               ADS EA,#-(INVLL+INVRI)
0623 8100               LD EA,#0
0625 C940               ADS EA,#INVLL
0627 1B                 JR UDRTB
0628 D910       UDRTA:  CPSE A,#KIU%16
062A 1B                 JR UDRTC
062B CE48               LD EA,INCB
062D C905               ADS EA,#(-(255-INVRI))%256
062F C9FF               ADS EA,#255
0631 81FF               LD EA,#255
0633 CD48       UDRTB:  LD INCB,EA
0635 C5                 RET
0636 D920       UDRTC:  CPSE A,#KSD%16
0638 1D                 JR UDRTF
0639 EB32               CALLS CPSA
063B DC9A               ADS EA,HL
063D 11                 JR UDRTD
063E 14                 JR UDRTE
063F C97B       UDRTD:  ADS EA,#(-(SPCUL/TØTØP))%256
0641 C985               ADS EA,#SPCUL/TØTØP
0643 8185       UDRTE:  LD EA,#SPCUL/TØTØP
0645 1A                 JR UDRTG
0646 EB32       UDRTF:  CALLS CPSA
0648 DCBA               SBS EA,HL
064A C9F5               ADS EA,#-(SPCLL/TØTØP)
064C 8100               LD EA,#0
064E C90B               ADS EA,#SPCLL/TØTØP
0650 CD44       UDRTG:  LD SPCB,EA
0652 C5                 RET
0653            ;
0653            ;       UPDATE/ADVANCE LEFT/RIGHT/BOTH SUBROUTINES
0653            ;
0653 D93B       UDLR:   LD H,#KSE
0655 F34C               BTST TSCF3
0657 EF7C               CALLS TFKG
0659 C5                 RET
065A 8C39       AVLR:   LD A,MTCF+3
065C AE                 ADS A,#-(1+1)
065D B2                 LD A,#3-1
065E A1                 ADS A,#1
065F 8939               LD MTCF+3,A
0661 C5                 RET
```

```
BIGMAN WAND CONTROL PROGRAM  (BGMNCP)                                  Page 36
Assembly Listing

 1412  0662                      EJECT
 1413  0662              ;
 1414  0662              ;       INITIALIZE HEATER STATUS SUBROUTINES
 1415  0662              ;
 1416  0662 8928         INHS:   LD HTCF+2,A
 1417  0664 F228                 BTSF HTE
 1418  0666 1E                   JR INHSB
 1419  0667 D9C9                 LD E,#-(2*2)
 1420  0669 B0                   LD A,#0
 1421  066A 82                   INCS HL
 1422  066B 82           INHSA:  INCS HL
 1423  066C C4                   LD @HL,A
 1424  066D 59                   INCS E
 1425  066E 0C                   JR INHSA
 1426  066F C028                 BITR HTC
 1427  0671 D128                 BITS HTP
 1428  0673 F128                 BITS HTE
 1429  0675 E128         INHSB:  BITS HTH
 1430  0677 D7                   BTST C
 1431  0678 E028                 BITR HTH
 1432  067A 96A4                 JPS UDHSC
 1433  067C              ;
 1434  067C              ;       UPDATE HEATER STATUS SUBROUTINE
 1435  067C              ;
 1436  067C 8928         UDHS:   LD HTCF+2,A
 1437  067E F228                 BTSF HTE
 1438  0680 1A                   JR UDHSA
 1439  0681 DC08                 LD EA,@HL
 1440  0683 DCD8                 DECS EA
 1441  0685 DC00                 LD @HL,EA
 1442  0687 C028                 BITR HTC
 1443  0689 96A4                 JPS UDHSC
 1444  068B 856A         UDHSA:  LD WX,#(-(HTWUD/T0T2P))%256
 1445  068D EF70                 CALLS ICTM
 1446  068F 16                   JR UDHSB
 1447  0690 8196                 LD EA,#HTWUD/T0T2P
 1448  0692 DC00                 LD @HL,EA
 1449  0694 C128                 BITS HTC
 1450  0696 85E2         UDHSB:  LD WX,#-(60/T0T2P)
 1451  0698 EF6E                 CALLS AITM
 1452  069A 19                   JR UDHSC
 1453  069B 85E2                 LD WX,#-HTOTD
 1454  069D EF6E                 CALLS AITM
 1455  069F 14                   JR UDHSC
 1456  06A0 D028                 BITR HTP
 1457  06A2 F028                 BITR HTE
 1458  06A4 8C28         UDHSC:  LD A,HTCF+2
 1459  06A6 C5                   RET
```

```
BIGMAN WAND CONTROL PROGRAM  (BGMNCP)                                  Page 37
Assembly Listing

06A7                        EJECT
06A7                ;
06A7                ;       UPDATE INTENSITY CONTROL SUBORUTINE
06A7                ;
06A7  815B          UDIC:   LD EA,#INCDL-INCLL
06A9  E208                  BTSF CFCF2
06AB  96E9                  JPS UDICE
06AD  8332                  LD HL,#INCAL-INCLL+INCHI
06AF  8539                  LD WX,#INCHL-INCLL
06B1  D308                  BTST CFCF1
06B3  852F                  LD WX,#INCHX-INCLL
06B5  F326                  BTST H1E
06B7  F227                  BTSF H2E
06B9  14                    JR UDICA
06BA  8328                  LD HL,#INCAL-INCLL
06BC  855B                  LD WX,#INCML-INCLL
06BE  D209          UDICA:  BTSF CFCF5
06C0  1C                    JR UDICB
06C1  E6                    RCF
06C2  8C36                  LD A,MTCF
06C4  EF52                  CALLS ADMI
06C6  8C37                  LD A,MTCF+1
06C8  EF52                  CALLS ADMI
06CA  E7                    SCF
06CB  96DB                  JPS UDICC
06CD  E7            UDICB:  SCF
06CE  D239                  BTSF MLE
06D0  C339                  BTST MRE
06D2  E6                    RCF
06D3  C236                  BTSF M1R
06D5  EF5D                  CALLS ICML
06D7  C237                  BTSF M2R
06D9  EF5D                  CALLS ICML
06DB  8C38          UDICC:  LD A,MTCF+2
06DD  EF52                  CALLS ADMI
06DF  DCFA                  LD EA,HL
06E1  DCB4                  SBS WX,EA
06E3  15                    JR UDICE
06E4  DCFA                  LD EA,HL
06E6  DC9C                  ADS EA,WX
06E8  A0                    NOP
06E9  CDC0          UDICE:  LD BTSQR,EA
06EB  CE4B                  LD EA,INCB
06ED  8700                  LD YZ,#0
06EF  8500                  LD WX,#0
06F1  D97A                  LD L,#7
06F3  1B                    JR UDICG
06F4  29            UDICF:  PUSH EA
06F5  E6                    RCF
06F6  DCFE                  LD EA,YZ
06F8  DCA6                  ADC YZ,EA
06FA  DCFC                  LD EA,WX
06FC  DCA4                  ADC WX,EA
06FE  28                    POP EA
06FF  F940          UDICG:  BTST BTSQR,@L
0701  14                    JR UDICH
```

BIGMAN WAND CONTROL PROGRAM (BGMNCP) Page 38
Assembly Listing

```
1516  0702 DC96              ADS YZ,EA
1517  0704 11                JR UDICH
1518  0705 84                INCS WX
1519  0706 4A        UDICH:  DECS L
1520  0707 96F4              JPS UDICF
1521  0709 8108              LD EA,#INCLL
1522  070B DC9C              ADS EA,WX
1523  070D CD4A              LD INCB+2,EA
1524  070F C5                RET
```

```
BIGMAN WAND CONTROL PROGRAM  (BGMNCP)                                  Page 39
Assembly Listing

 1525  0710                      EJECT
 1526  0710             ;
 1527  0710             ;        ENABLE MOTORS SUBROUTINE
 1528  0710             ;
 1529  0710 8C36        EAMT:    LD A,MTCF
 1530  0712 F8F6                 BTSF P6.3
 1531  0714 F100                 BITS AREG.3
 1532  0716 D309                 BTST CFCF5
 1533  0718 16                   JR EAMTA
 1534  0719 E000                 BITR AREG.2
 1535  071B D239                 BTSF MLE
 1536  071D E100                 BITS AREG.2
 1537  071F 89F6        EAMTA:   LD P6,A
 1538  0721 8C37                 LD A,MTCF+1
 1539  0723 D309                 BTST CFCF5
 1540  0725 16                   JR EAMTB
 1541  0726 E000                 BITR AREG.2
 1542  0728 C239                 BTSF MRE
 1543  072A E100                 BITS AREG.2
 1544  072C 89F3        EAMTB:   LD P3,A
 1545  072E 8C38                 LD A,MTCF+2
 1546  0730 89F0                 LD P0,A
 1547  0732 D321                 BTST LDE
 1548  0734 E5                   SRET
 1549  0735 C5                   RET
 1550  0736             ;
 1551  0736             ;        DISABLE MOTORS SUBROUTINE
 1552  0736             ;
 1553  0736 D309        DAMT:    BTST CFCF5
 1554  0738 FEE6                 BITR P6.2
 1555  073A FED6                 BITR P6.1
 1556  073C FEC6                 BITR P6.0
 1557  073E D309                 BTST CFCF5
 1558  0740 FEE3                 BITR P3.2
 1559  0742 FED3                 BITR P3.1
 1560  0744 FEC3                 BITR P3.0
 1561  0746 B0                   LD A,#00H
 1562  0747 89F0                 LD P0,A
 1563  0749 C5                   RET
 1564  074A             ;
 1565  074A             ;        RESET MODE INDICATORS SUBROUTINE
 1566  074A             ;
 1567  074A FFF5        RSMI:    BITS P5.3
 1568  074C FFF6                 BITS P6.3
 1569  074E BF                   LD A,#0FH
 1570  074F 89F4                 LD P4,A
 1571  0751 C5                   RET
```

```
BIGMAN WAND CONTROL PROGRAM  (BGMNCP)                                  Page 40
Assembly Listing

 1572  0752                      EJECT
 1573  0752            ;
 1574  0752            ;         ADD MOTOR INCREMENT SUBROUTINE
 1575  0752            ;
 1576  0752 C200       ADMI:     BTSF AREG.0
 1577  0754 EF5D                 CALLS ICML
 1578  0756 D200                 BTSF AREG.1
 1579  0758 EF5D                 CALLS ICML
 1580  075A E300                 BTST AREG.2
 1581  075C C5                   RET
 1582  075D            ;
 1583  075D            ;         INCREMENT MOTOR LIMITS SUBROUTINE
 1584  075D            ;
 1585  075D 29         ICML:     PUSH EA
 1586  075E D7                   BTST C
 1587  075F 8104                 LD EA,#INCMI
 1588  0761 8108                 LD EA,#INCMI*2
 1589  0763 DC92                 ADS HL,EA
 1590  0765 D7                   BTST C
 1591  0766 8101                 LD EA,#INCLD
 1592  0768 8102                 LD EA,#INCLD*2
 1593  076A DCB4                 SBS WX,EA
 1594  076C 28                   POP EA
 1595  076D C5                   RET
 1596  076E            ;
 1597  076E            ;         INCREMENT TIMER SUBROUTINES
 1598  076E            ;
 1599  076E 82         AITM:     INCS HL
 1600  076F 82                   INCS HL
 1601  0770 DC08       ICTM:     LD EA,@HL
 1602  0772 C901                 ADS EA,#1
 1603  0774 DC00                 LD @HL,EA
 1604  0776 DC9C                 ADS EA,WX
 1605  0778 C5                   RET
 1606  0779 DC00                 LD @HL,EA
 1607  077B E5                   SRET
 1608  077C            ;
 1609  077C            ;         TEST FOR KEY GROUP SUBROUTINE
 1610  077C            ;
 1611  077C CE1C       TFKG:     LD EA,KBDB
 1612  077E 69                   XCH A,E
 1613  077F F214                 BTSF KEF
 1614  0781 DD6B                 CPSE A,H
 1615  0783 C5                   RET
 1616  0784 69                   XCH A,E
 1617  0785 F014                 BITR KEF
 1618  0787 E5                   SRET
```

```
BIGMAN WAND CONTROL PROGRAM  (BGMNCP)                                  Page 41
Assembly Listing

 1619  0788                        EJECT
 1620  0788              ;
 1621  0788              ;         PROGRAM MEMORY ENDING PAGE
 1622  0788              ;
 1623  0788                        IF ($&0700H)!=0700H
 1624  0788                        ORG 0700H
 1625  0788                        THEN
 1626  0788              ;
 1627  0788              ;         LOAD INDIRECT EA SUBROUTINE
 1628  0788              ;
 1629  0788 C8           LIEA:     LDC EA,@EA
 1630  0789 C5                     RET
 1631  078A              ;
 1632  078A              ;         LOAD INDIRECT WX SUBROUTINE
 1633  078A              ;
 1634  078A CC           LIWX:     LDC EA,@WX
 1635  078B C5                     RET
 1636  078C              ;
 1637  078C              ;         ZONE SELECT TABLE
 1638  078C              ;
 1639  078C 01           ZNST:     DB 001H
 1640  078D 02                     DB 002H
 1641  078E 04                     DB 004H
 1642  078F 08                     DB 008H
 1643  0790 10                     DB 010H
 1644  0791              ;
 1645  0791              ;         SPECIAL EFFECT SELECT TABLE
 1646  0791              ;
 1647  0791 1441         SEST:     DB 014H,041H
 1648  0793 0502                   DB 005H,002H
 1649  0795 4411                   DB 044H,011H
 1650  0797 5002                   DB 050H,002H
 1651  0799 5020                   DB 050H,020H
 1652  079B 0520                   DB 005H,020H
 1653  079D 4010                   DB 040H,010H
 1654  079F 5000                   DB 050H,000H
 1655  07A1              ;
 1656  07A1              ;         KEYBOARD CODE TABLE
 1657  07A1              ;
 1658  07A1 43002251     KBCT:     DB KZ4,0,KPL,KIU,KID
       07A5 50
 1659  07A6 42122000               DB KZ3,KHL,KMN,0,KEL
       07AA 36
 1660  07AB 41132153               DB KZ2,KHH,KWV,KSU,KSD
       07AF 52
 1661  07B0 40103032               DB KZ1,KPW,KE1,KE3,KE5
       07B4 34
 1662  07B5 44003133               DB KZ5,0,KE2,KE4,KE6
       07B9 35
 1663  07BA              ;
 1664  07BA              ;         END OF PROGRAM
 1665  07BA              ;
 1666  07BA                        END
```

BIGMAN WAND CONTROL PROGRAM (BGMNCP) Page 42
Constant Symbol Table

| | | | | | |
|---|---|---|---|---|---|
| AREG | 0000 | ITCF1 | 000A.0001 | MTCF | 0036 |
| ATE | 000A.0003 | ITCF2 | 000A.0002 | OMCF | 003A |
| BTCTR | 0F86 | KBCB | 0016 | P2MDR | 0FE2 |
| BTICR | 0FB8 | KBCF | 0014 | PCONR | 0FB3 |
| BTMDR | 0F85 | KBCF0 | 0014.0000 | PGSK | 0000 |
| BTSQR | 0FC0 | KBCF1 | 0014.0001 | PLCF | 0042 |
| CFCF | 0008 | KBCF4 | 0015.0000 | PLCF0 | 0042.0000 |
| CFCF0 | 0008.0000 | KBDB | 001C | PLM | 003A.0001 |
| CFCF1 | 0008.0001 | KBDBD | 0050 | PMG1R | 0FE8 |
| CFCF2 | 0008.0002 | KBICR | 0FBF | PMG2R | 0FEA |
| CFCF4 | 0009.0000 | KBKPD | 07D0 | PMG3R | 0FEC |
| CFCF5 | 0009.0001 | KBKRD | 0064 | PUMDR | 0FDC |
| CFCF6 | 0009.0002 | KCT | 0001 | PWCB | 0022 |
| CFCF7 | 0009.0003 | KE1 | 0030 | PWCF | 0020 |
| COMDR | 0FD0 | KE2 | 0031 | PWK | 0015.0001 |
| CPMDR | 0FD6 | KE3 | 0032 | PWOT1 | 000F |
| CPRSR | 0FD4 | KE4 | 0033 | PWOT2 | 001E |
| DFINL | 003D | KE5 | 0034 | SECB | 0040 |
| DFSPL | 03E8 | KE6 | 0035 | SEM | 003A.0003 |
| EREG | 0001 | KEF | 0014.0003 | SIBFR | 0FE4 |
| EXICR | 0FBE | KEL | 0036 | SIDSP | 0033 |
| H1C | 0026.0000 | KHH | 0013 | SIICR | 0FBD |
| H1CB | 002A | KHL | 0012 | SIMDR | 0FE0 |
| H1E | 0026.0003 | KID | 0050 | SPCB | 0044 |
| H1H | 0026.0002 | KIU | 0051 | SPCLL | 0136 |
| H1P | 0026.0001 | KMD | 0002 | SPCUL | 0EA6 |
| H2C | 0027.0000 | KMN | 0020 | SPE | 000B.0000 |
| H2CB | 0030 | KPL | 0022 | T0CTR | 0F94 |
| H2E | 0027.0003 | KPW | 0010 | T0CYT | 000E |
| H2H | 0027.0002 | KRT | 0005 | T0ICR | 0FBC |
| H2P | 0027.0001 | KSD | 0052 | T0IEN | 0FBC.0001 |
| HREG | 0003 | KSE | 0003 | T0IRQ | 0FBC.0000 |
| HTC | 0028.0000 | KSU | 0053 | T0IUL | 0007 |
| HTCF | 0026 | KWV | 0021 | T0MDR | 0F90 |
| HTCYP | 003C | KZ1 | 0040 | T0RFR | 0F96 |
| HTE | 0028.0003 | KZ2 | 0041 | T0SPT | 0023 |
| HTFDD | 0064 | KZ3 | 0042 | T0T0P | 001C |
| HTFED | 0DAC | KZ4 | 0043 | T0T2P | 0002 |
| HTH | 0028.0002 | KZ5 | 0044 | TMOER | 0F92 |
| HTOTD | 001E | KZN | 0004 | TSCF | 004C |
| HTP | 0028.0001 | LDE | 0021.0001 | TSCF0 | 004C.0000 |
| HTWUD | 012C | LREG | 0002 | TSCF1 | 004C.0001 |
| I0MDR | 0FB4 | M1C | 0036.0001 | TSCF3 | 004C.0003 |
| I1MDR | 0FB5 | M1L | 0036.0002 | TSCF7 | 004D.0003 |
| I2MDR | 0FB6 | M1R | 0036.0000 | TSMED | 0BB8 |
| INCAL | 0030 | M2C | 0037.0001 | TSMSD | 03E8 |
| INCB | 0048 | M2L | 0037.0002 | WREG | 0005 |
| INCDL | 0063 | M2R | 0037.0000 | WTICR | 0FBA |
| INCHI | 000A | M3B | 0038.0002 | WTMDR | 0F88 |
| INCHL | 0041 | M4B | 0038.0001 | WVM | 003A.0002 |
| INCHX | 0037 | M5B | 0038.0000 | XREG | 0004 |
| INCLD | 0001 | MCTOD | 0082 | YREG | 0007 |
| INCLL | 0008 | MIDEP | 0010 | Z1E | 003C.0000 |
| INCMI | 0004 | MISA | 000A | Z2E | 003C.0001 |
| INCML | 0063 | MLE | 0039.0001 | Z3E | 003C.0002 |
| INPRR | 0FB2 | MNM | 003A.0000 | Z4E | 003C.0003 |
| INVLL | 0040 | MPE | 0020.0003 | Z5E | 003D.0000 |

```
BIGMAN WAND CONTROL PROGRAM  (BGMNCP)                                  Page 43
Constant Symbol Table

        INVRI 0004              MPX 0020.0002          ZNCF 003C
         ITCB 000C              MRE 0039.0000          ZREG 0006
         ITCF 000A              MSE 0021.0000          ZSCB 003E
        ITCF0 000A.0000
```

BIGMAN WAND CONTROL PROGRAM (BGMNCP) Page 44
Label Symbol Table

| | | | | | |
|---|---|---|---|---|---|
| ADMI | 0752 | MPRS | 0094 | TGZN | 02D6 |
| AITM | 076E | PLMD | 013A | TSMD | 01BE |
| AVLR | 065A | PLMDA | 0142 | TSMDA | 01E2 |
| AVSE | 02E5 | PLMDB | 014A | TSMDB | 01ED |
| AVZS | 0280 | PLMDC | 0152 | TSMDC | 01FF |
| AVZSA | 028C | POIN | 002D | TSMDD | 0217 |
| AVZSB | 029C | POINA | 0074 | TSMDE | 023A |
| AVZSC | 02A0 | POINB | 0078 | TSMDF | 0240 |
| AVZSD | 02AC | POINC | 007D | TSMDG | 0246 |
| AVZSE | 02B4 | POIND | 0089 | TSMDH | 025A |
| AVZSF | 02B8 | PRZN | 02D3 | TSMDI | 0260 |
| CPSA | 0332 | RSMI | 074A | TSMDJ | 0267 |
| DAMT | 0736 | RSMT | 0368 | UDHS | 067C |
| EAMT | 0710 | RSOM | 0324 | UDHSA | 068B |
| EAMTA | 071F | RSSC | 030B | UDHSB | 0696 |
| EAMTB | 072C | RSTM | 032B | UDHSC | 06A4 |
| ICML | 075D | RSZN | 02CC | UDIC | 06A7 |
| ICTM | 0770 | SATM | 033E | UDICA | 06BE |
| IEMT | 0351 | SEMD | 0189 | UDICB | 06CD |
| IMPW | 0300 | SEMDA | 018D | UDICC | 06DB |
| INHS | 0662 | SEMDB | 018F | UDICE | 06E9 |
| INHSA | 066B | SEMDC | 0193 | UDICF | 06F4 |
| INHSB | 0675 | SEMDD | 019A | UDICG | 06FF |
| INZN | 02C9 | SEMDE | 01A2 | UDICH | 0706 |
| INZS | 0277 | SEMDF | 01AF | UDLR | 0653 |
| IRPW | 02FE | SEMT | 036D | UDPW | 059C |
| IZMT | 0357 | SEST | 0791 | UDPWA | 05B8 |
| IZMTA | 035C | SLZM | 0118 | UDPWB | 05C8 |
| IZMTB | 0363 | SLZMA | 011D | UDPWC | 05E1 |
| KBCT | 07A1 | SZMT | 0378 | UDPWD | 05ED |
| KBSC | 049C | SZMTA | 0396 | UDPWE | 05F2 |
| KBSCA | 04A2 | TØIØ | 03AD | UDPWF | 05F9 |
| KBSCB | 04D2 | TØIØA | 03D1 | UDPWG | 0602 |
| KBSCC | 04DE | TØIØB | 03D7 | UDPWH | 0609 |
| KBSCD | 04FD | TØIØC | 03E6 | UDPWI | 0612 |
| KBSCE | 0503 | TØIØD | 03EA | UDRT | 0617 |
| KBSCF | 0521 | TØIØE | 03F3 | UDRTA | 0628 |
| KBSCG | 0532 | TØIØF | 03FF | UDRTB | 0633 |
| KBSCH | 054B | TØIØG | 0408 | UDRTC | 0636 |
| KBSCI | 0555 | TØI1 | 041A | UDRTD | 063F |
| LDSE | 02F0 | TØI1A | 0439 | UDRTE | 0643 |
| LDZS | 02BA | TØI1B | 0451 | UDRTF | 0646 |
| LIEA | 078B | TØI1C | 0455 | UDRTG | 0650 |
| LIWX | 078A | TØI1D | 0462 | UDTM | 055A |
| MNMD | 0122 | TØI1E | 046E | UDTMA | 0561 |
| MNMDA | 0126 | TØI1F | 0477 | UDTMB | 0571 |
| MNMDB | 012A | TØI1G | 0479 | UDTMC | 0585 |
| MPID | 00AC | TØI1H | 0485 | UDTMD | 058E |
| MPIDA | 00B2 | TØI1I | 048C | WFSF | 0316 |
| MPIDB | 00C5 | TØIP | 03A1 | WVMD | 0164 |
| MPIDC | 00D7 | TØIR | 0497 | WVMDA | 016C |
| MPIDD | 00E5 | TFKE | 0349 | WVMDB | 0170 |
| MPIDE | 00F3 | TFKG | 077C | WVMDC | 0177 |
| MPIDF | 0101 | TFKR | 0345 | ZNST | 078C |
| MPIDG | 0114 | TFSF | 031E | | |

BICMAN WAND CONTROL PROGRAM (BGMNCP) Page 45
Program Segment Table

| Start | Length | End | Start | Length | End | Start | Length | End |
|---|---|---|---|---|---|---|---|---|
| Ø | 7BA | 7B9 | | | | | | |

What is claimed is:

1. A massaging system comprising:

a pad comprising a plurality of zones;

vibrators located in proximity to each of the zones, each vibrator comprising a motor and a mass element eccentrically coupled to the motor for driving the vibrators at an intensity;

a controller coupled to a program memory and to the vibrators;

an operator control device coupled to the controller for signaling the controller in response to operator input;

a heater in the pad; and firmware stored in the memory and executed by the controller, the firmware comprising instructions for selectively operating the vibrators in a pulse mode and a wave mode in response to the operator input, wherein the firmware comprises instructions for reducing the intensity of the vibrators when the heater is on.

2. The massaging system of claim 1, wherein the pulse mode comprises a tapping mode that simultaneously activates selected vibrators for a first duration and deactivates the selected vibrators for a second duration.

3. The massaging system of claim 2, wherein at least one of the first duration and the second duration are adjustable using the operator control device, and wherein the first duration is less than the second duration.

4. The massaging system of claim 2, wherein the firmware further comprises instructions for operating the vibrators according a test mode that activates each vibrator in a preselected order.

5. The massaging system of claim 2, further comprising a configuration selector coupled to the controller, and wherein the firmware further comprises instructions for accessing the configuration selector to determine a product type governed by the controller.

6. The massaging system of claim 5, the firmware further comprises instructions for operating a plurality of different product types.

7. The massaging system of claim 1, wherein the vibrators comprise first zone vibrators and second zone vibrators, and wherein the wave mode comprises driving the first and second zone vibrators sequentially.

8. The massaging system of claim 1, further comprising a heater in the pad.

9. The massaging system of claim 8, wherein the firmware further comprises instructions responsive to the operator control device to operate the heat between an on setting and an off setting.

10. The massaging system of claim 8, wherein the firmware further comprises instructions responsive to the operator control device to operate the heat between an on setting and at least two heat settings.

11. The massaging system of claim 8, wherein the firmware further comprises instructions for operating the vibrators according to a test mode that activates each vibrator and the heater in a predetermined order.

12. A massaging system according to claim 1, wherein the pulse mode comprises a tapping mode that drives selected vibratory transducers at a duty cycle setting comprising less than 50 percent on-time.

13. A massaging system according to claim 1, wherein the firmware comprises instructions responsive to the speed input element for non-linearly changing vibratory transducer step period.

14. A massaging system comprising:

a pad comprising a plurality of zones;

vibratory transducers in the pad for vibrating the zones, each transducer comprising a motor and a mass element eccentrically coupled to the motor;

a microcontroller comprising an input interface and an output interface;

a program memory coupled to the microcontroller;

input elements including an intensity input element and a speed input element coupled to the input interface for signaling the microcontroller in response to operator input;

a motor driver coupled to the output interface and the vibratory transducers for driving the vibratory transducers at an intensity in response to the operator input;

firmware stored in the memory and executed by the microcontroller, the firmware comprising instructions for selectively operating the vibratory transducers in a pulse mode and in a wave mode in response to the operator input; and a heater in the pad, wherein the intensity of the vibratory transducers is reduced when the heater is on, and wherein the firmware comprises instructions for reducing the intensity of the vibratory transducers when the heater is on.

15. The massaging system of claim 14, the pulse mode comprises a tapping mode that drives selected vibratory transducers at a first duty cycle setting.

16. The massaging system of claim 15, wherein the firmware further comprises instructions responsive to the intensity and speed input elements to control the intensity and speed of the vibratory transducers.

17. The massaging system of claim 14, wherein the pulse mode comprises a tapping mode that drives selected vibratory transducers at a duty cycle setting comprising less than 50 percent on-time.

18. A massaging system according to claim 17, wherein:

the pulse mode comprises the tapping mode and an additional mode for driving selected vibratory transducers at a duty cycle setting of approximately 50% on time.

19. The massaging system of claim 14, wherein the vibratory transducers include at least first zone transducers and second zone transducers, and wherein the wave mode comprises driving the first and second zone transducers sequentially.

20. The massaging system of claim 19, wherein the firmware further comprises instructions responsive to the intensity and speed input elements to control the intensity and speed of the vibratory transducers.

21. The massaging system of claim 14, further comprising a heater in the pad.

22. The massaging system of claim 21, wherein at least one of the input elements is a heat input element, and wherein the firmware further comprises instructions responsive to operate the heater between an on setting and an off setting.

23. The massaging system of claim 22, wherein the firmware further comprises instructions responsive to the heat input element to cycle the heater between an off setting, a low heat setting, and a high heat setting.

24. The massaging system of claim 14, wherein the motors are characterized during operation by a step period, and wherein the firmware further comprises instructions responsive to the speed input element for changing the step period in non-linear steps.

25. The massaging system of claim 14, the firmware further comprises instructions for operating the vibratory transducers in a test mode that activates each vibratory transducer in a predetermine order.

26. The massaging system of claim 14, further comprising an audio detector that provides a connection to an external audio signal.

27. The massaging system of claim 20, wherein the firmware obtains an intensity control value from an envelope of the audio signal.

* * * * *